US007162982B2

(12) United States Patent
Rabhi

(10) Patent No.: US 7,162,982 B2
(45) Date of Patent: Jan. 16, 2007

(54) HYDRAULIC VALVE ACTUATOR FOR RECIPROCATING ENGINE

(76) Inventor: Vianney Rabhi, 35 cours d'Herbouville, 69004, Lyon (FR)

( * ) Notice: Subject to any disclaimer, the term of this patent is extended or adjusted under 35 U.S.C. 154(b) by 0 days.

(21) Appl. No.: 10/521,739

(22) PCT Filed: Jul. 18, 2003

(86) PCT No.: PCT/FR03/02271

§ 371 (c)(1),
(2), (4) Date: Oct. 3, 2005

(87) PCT Pub. No.: WO2004/011780

PCT Pub. Date: Feb. 5, 2004

(65) Prior Publication Data

US 2006/0102117 A1 May 18, 2006

(30) Foreign Application Priority Data

Jul. 23, 2002 (FR) ..... 02 09323

(51) Int. Cl.
*F01L 9/02* (2006.01)

(52) U.S. Cl. ..... 123/90.12; 123/90.13; 123/90.11; 251/12; 251/129.01

(58) Field of Classification Search ..... 123/90.12, 123/90.13, 90.11, 90.15; 251/12, 129.01, 251/129.16; 91/170 R, 172, 182, 183
See application file for complete search history.

(56) References Cited

U.S. PATENT DOCUMENTS

| | | | | |
|---|---|---|---|---|
| 4,531,706 | A | 7/1985 | Weiger et al. | |
| 5,255,641 | A | 10/1993 | Schechter | |
| 5,713,331 | A | 2/1998 | Eisenbacher et al. | |
| 6,857,403 | B1 * | 2/2005 | Diehl et al. | 123/90.12 |

FOREIGN PATENT DOCUMENTS

| | | |
|---|---|---|
| DE | 42 32 573 | 4/1993 |

* cited by examiner

*Primary Examiner*—Ching Chang
(74) *Attorney, Agent, or Firm*—Young & Thompson

(57) ABSTRACT

A hydraulic valve actuator for reciprocating engine includes at least a hydraulic cylinder (3) for opening at least one valve (2) via at least one valve opening selector (11) with at least one hydraulic positive displacement pump (4) whereof the hydraulic fluid supplied at the output can be forced into a high pressure circuit (10) by at least one pump outlet closure (8), the valve (2) capable of being maintained opened by an opening non-return valve (24), then of being reseated by a valve closing selector (25) which directs the hydraulic fluid contained in the hydraulic cylinder (3) in the hydraulic positive displacement pump (4) input by co-operating with a pump input non-return valve (26).

57 Claims, 16 Drawing Sheets

HYDRAULIC VALVE ACTUATOR FOR RECIPROCATING ENGINE

This application is the 35 USC 371 national stage of International Application PCT/FR03/02271 filed on Jul. 18, 2003, which designated the United States of America. International Application PCT/FR03/02271 claims priority to French Application No. 02 09323, filed on Jul. 23, 2002.

The present invention relates to a hydraulic actuator making it possible to control the lift, the opening advance and/or the closing retard of the valves of reciprocating engines.

At the present time, the opening point of the valves of reciprocating engines as a function of the angle of rotation of the crankshaft is defined by the angular phasing of the camshaft or camshafts with respect to said crankshaft. The opening duration and the lift of the valves are defined by the cam profile. As a general rule, and in most engines currently produced by the motor vehicle industry, these characteristics are fixed.

Experience has revealed the usefulness of controlling the parameters which are the opening point, the opening duration and the lift of the valves of the reciprocating internal combustion engines used in motor vehicles. To be precise, these parameters have a major effect on the filling of the cylinder or cylinders and on the combustion conditions, and controlling them during operation makes it possible to optimize efficiency and power as a function of the rotational speed of the engine and of the desired load and to control emissions.

The control of these parameters makes it possible, in particular:

To have a high torque at all rotational speeds by causing the opening and closing of the intake and/or exhaust valves at the moment which is the most suitable for the maximum filling of the cylinder, taking into account, in particular, the inertia of the gases in the intake and exhaust manifolds.

To have a high maximum power without detriment to the torque and the flexibility of the engine at low rotational speeds.

To regulate the charge introduced into the cylinder by valve regulation directly at the valve, instead of using a throttle flap, by acting on the lift and/or the opening time of the intake valve or valves, thus limiting the pumping losses detrimental to the efficiency of the engine.

To have a better control of the turbulence in the combustion chamber, particularly by virtue of the control of the valve lift height, thus making it possible to control the speed of the gases introduced into the cylinder and thereby to control the homogeneity of the air/fuel mixture and the combustion speed.

To regulate the ratio of burnt gases diluted in the charge introduced into the cylinder or cylinders, in particular by selecting a greater or lesser crossing of valves (time when the intake and exhaust valves are open simultaneously in the same cylinder), thus allowing a greater control of emissions and of efficiency, and making it possible to have a lower cyclic dispersion (combustion irregularities, ignition misfires), thus permitting a lowering of the idling speed of the engine.

Furthermore, the control of Closing Retard Intake makes it possible to regulate the charge introduced into the cylinder by backflow, in other words by the return of the excess fresh intake gases into the intake manifold. This technique has its full expression in engines with a variable compression ratio, since it makes it possible to employ the Atkinson cycle which has higher efficiency under part loads than the Otto or Beau de Rochas cycle.

In an atmospheric or supercharged engine with a fixed compression ratio, the backflow obtained by the control of Closing Retard Intake makes it possible to control the actual compression stroke, thus making possible to provide a higher compression ratio affording higher efficiency under part loads and permitting a better control of pinking and efficiency at all rotational speeds.

In a variable-ratio engine, the control of the lift makes it possible to limit the depth of lapping of the valves in the piston (imprints having the shape of the valves on the piston) by allowing a lower lift of the valves under part loads when the compression ratio is high.

There are various technologies which make it possible to control all or some of these parameters which are the opening advance, the opening duration and the lift of the valves in reciprocating internal combustion engines: from simple camshaft phase shifters which are industrialized up to electromechanical or electrohydraulic devices affording a control of all of said parameters, but still at the experimental stage because they have major shortcomings in terms of extra cost, reliability, controllability or excess energy consumption.

Various camshaft phase shifters and lift control devices are sold in large series, but they are costly and have controllability limits: simple phase shifters with a plurality of predefined positions or with continuous variation do not make it possible to control independently the opening advance and the closing retard of the valves and therefore do not make it possible to control the opening duration. Furthermore, they do not make it possible to control the lift.

Some devices, such as that known by the trade name of "VTec" of "Honda" or "Variocam Plus" of "Porsche", comprise two different cam profiles which make it possible to choose between two different laws of lift of the intake valves as a function of the operating conditions of the engine.

The most elaborate device which is sold at the present time is probably that known by the trade name "Valvetronic" developed by "BMW", which makes it possible to control the lift of the valves and, coupled to phase shifting "Vanos" of the camshafts, makes it possible to regulate virtually all the parameters, with the exception of the setting of the closing retard which remains linked to that of the opening advance, thus preventing the control of the opening time of the valves.

Solenoid-type electromagnetic actuators have the best level of parameterization at the present time, but considerable shortcomings make it difficult for them to be industrialized, these including excess energy consumption, the roaring of the valves at high rotational speeds, the lack of progression during the resting of the valves on their seat, the overheating of their electrical components or the need to provide a higher electrical supply voltage than that normally generated on the vehicle. Moreover, their manufacturing cost price is high, and their reliability is difficult to ensure throughout the useful life of a vehicle.

Electrohydraulic devices have also been developed, such as that intended especially for engines with a low rotational speed built by "Sturman" in the United States in collaboration with "Siemens".

Whether electromagnetic or electrohydraulic actuators are concerned, these devices have the disadvantage of a high energy consumption, thus diminishing their usefulness in terms of an improvement in efficiency of the engine.

There is no technology existing today which is at the same time simple, reliable, economical in terms of energy, easy to industrialize, uncomplicated and allowing the independent control of the opening advance, the closing retard and the lift of the valves of reciprocating internal combustion engines.

In order to respond to the unavailability of such a technology for the motor vehicle engine industry, the device according to the invention, according to a particular embodiment, allows:

the independent control of the opening advance of the valves, the independent control of the closing retard of the valves, the independent control of the lift of the valves, quiet and energy-conserving functioning.

Thus, the device according to the invention makes it possible to implement the essential part of the strategies of the improvement in power, efficiency and emission control by the control of the opening advance, opening duration and lift of valves. Furthermore, the device according to the invention has a reliability level and a production cost which are compatible with the requirements of the motor vehicle industry.

The device according to the invention is distinguished from the valve drive devices according to the prior art in that:

a) the camshaft and also any rockers are omitted, b) the cylinder head is simplified, particularly owing to the elimination of the camshaft line normally embodied by bearings and their lubricating device, and owing to the elimination of the bores of valve tappets, c) according to a particular embodiment, the vertical bulk of the engine can be reduced owing to the elimination of the camshaft, d) the alternative mass of the assembly consisting of the valves and of their drive device is reduced, particularly owing to the elimination of the tappets and/or of the rockers, thus reducing the force necessary for the acceleration and deceleration of said assembly during opening and closing of the valves, e) the devices for setting the play between cams and tappets, such as an adjusting washer, adjusting screw or hydraulic tappet, are eliminated, f) the orientation of the valves in the cylinder head is facilitated.

Thus, the hydraulic valve actuator for reciprocating engines according to the present invention comprises:

at least one hydraulic jack connected to a high-pressure hydraulic circuit by means of a duct and ensuring the opening of at least one valve, at least one hydraulic positive displacement pump comprising at least one outlet and at least one inlet, the rotational speed of which is proportional to that of the engine crankshaft, at least one pump outlet plug which makes it possible to prevent the hydraulic fluid expelled at the outlet of the hydraulic positive displacement pump from issuing into a low-pressure circuit or into a reservoir and to force it to be directed toward a high-pressure circuit communicating with one or more hydraulic jacks ensuring the opening of one or more valves, at least one valve opening selector which makes it possible to direct, via the high-pressure circuit, the hydraulic fluid expelled at the outlet of the hydraulic positive displacement pump toward the hydraulic jack of at least one valve to be opened, while at the same time preventing said hydraulic fluid from being directed toward one or more other valves to remain closed, at least one opening nonreturn valve which is located on the high-pressure circuit between the pump outlet and the hydraulic jack of at least one valve and which makes it possible to retain the hydraulic fluid in said hydraulic jack of said valve in order to keep it open, at least one valve closing selector which makes it possible to direct the hydraulic fluid contained in the hydraulic jack of at least one valve kept open by the opening nonreturn valve toward the inlet or inlets of the hydraulic positive displacement pump, in order to ensure the closing of said valve or valves and to prevent the hydraulic fluid contained in their hydraulic jack from being introduced into the hydraulic jack of another valve or other valves which is or are to remain in a closed position, and at least one pump inlet nonreturn valve which makes it possible for the hydraulic fluid of the low-pressure circuit or of the reservoir to be admitted at the inlet or inlets of the hydraulic positive displacement pump when the pressure of said low-pressure circuit or of said reservoir is higher than that of said inlet or inlets of the hydraulic positive displacement pump.

The other essential characteristics of the present invention have been described in the description and in the subclaims dependent directly or indirectly on the main claim.

The hydraulic valve actuator for reciprocating engines according to the present invention comprises:

a hydraulic jack on the or each valve of the engine, which ensures the opening, the keeping in an open position and the closing of said valve(s), a hydraulic positive displacement pump, the rotational speed of which is proportional to that of the crankshaft, and a device incorporating an assembly of various valves.

The device incorporating an assembly of various valves has the function:

of directing the hydraulic fluid delivered at the outlet of the hydraulic positive displacement pump toward the hydraulic jack of the valve or valves at the desired moment as a function of the angular position of the crankshaft, in order to ensure the lift of said valve or valves, of directing the hydraulic fluid delivered at the outlet of the hydraulic positive displacement pump toward the hydraulic jack of the valve or valves during the desired number of crankshaft degrees of rotation, in order to ensure the lift of said valve or valves to the desired height, of keeping the hydraulic fluid enclosed in the hydraulic jack of the valve or valves in order to keep said valve or valves open during the desired number of crankshaft degrees of rotation, of directing the hydraulic fluid contained in the jack of the valve or valves toward the inlet of the hydraulic positive displacement pump at the desired moment as a function of the angular position of the crankshaft, in order to ensure the resting of said valve or valves and recover part of the energy stored by the return spring of the valve or valves during the opening of the latter.

According to a particular embodiment, the device according to the invention comprises:

one or more electric motors subject to one or more computers and making it possible to control:

the opening point of the valve or valves as a function of the angular position of the crankshaft, the lift height of the valve or valves, the closing point of the valve or valves as a function of the angular position of the crankshaft, a device for measuring the crankshaft angle, which, twinned with a device for measuring the valve lift, informs the computer or computers of the actual opening point, lift height and closing point of the valve or valves of the engine. The assembly of said measuring devices and of said computers providing a control loop ensuring sufficient accuracy for the movement of the valve or valves of the engine.

The following description, with reference to the accompanying drawings given by way of nonlimiting examples, will make it possible to understand more clearly the invention, its characteristics and the advantages which it is capable of affording:

Figure 1:
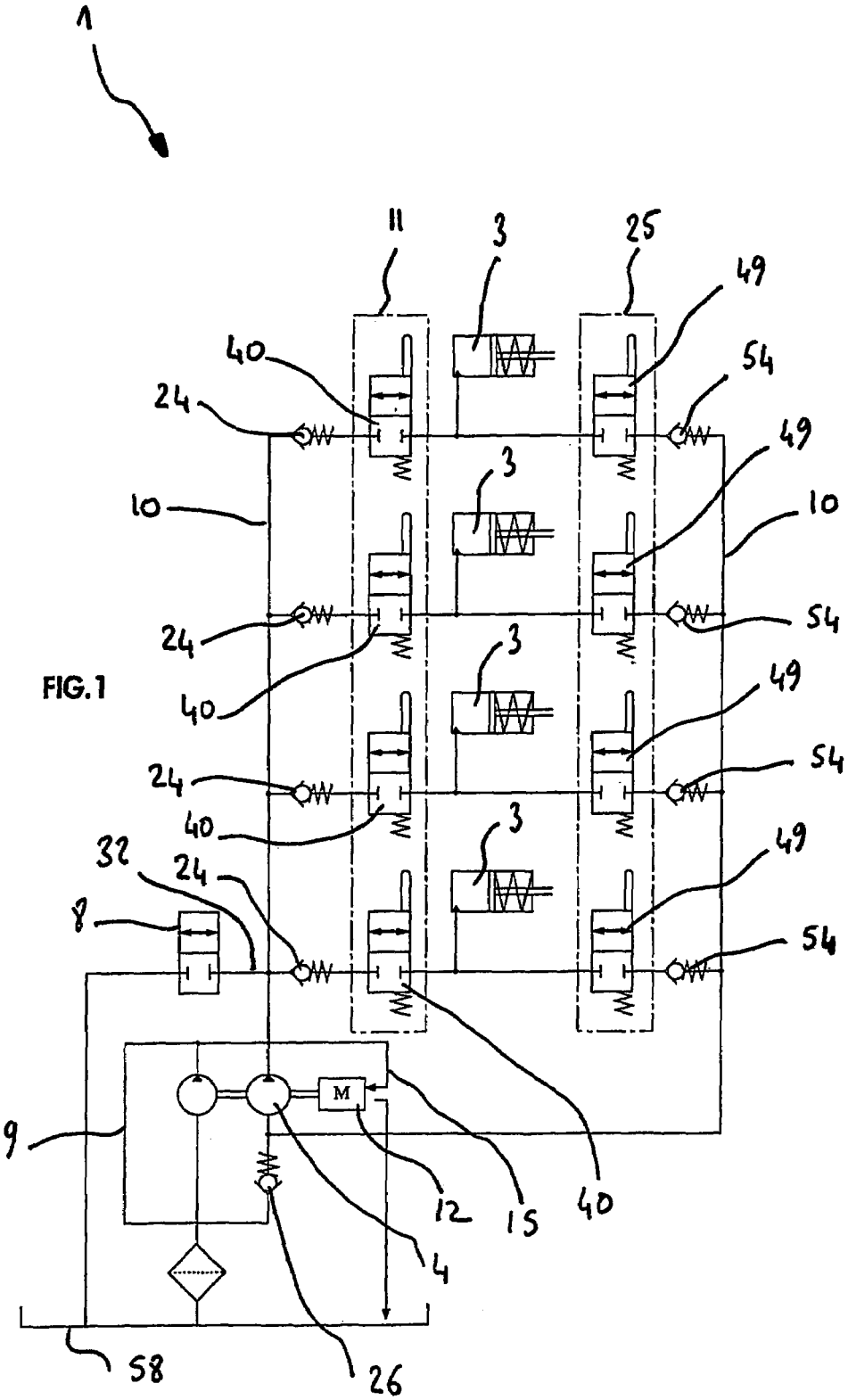
FIG. 1 illustrates a basic diagram of the hydraulic actuator according to the present invention in a configuration with four valves (for example, in order to actuate the four intake valves of a four-cylinder engine).

FIGS. 1 to 3 and 22 show a hydraulic actuator 1 comprising at least one hydraulic jack 3 which is connected to a high-pressure hydraulic circuit 10 by means of a duct, in order to ensure the opening of at least one valve 2 of a reciprocating engine 12.

The hydraulic actuator 1 comprises at least one hydraulic positive displacement pump 4 comprising at least one outlet 6 and at least one inlet 7 and the rotational speed of which is proportional to that of the crankshaft 5 of the engine 12.

The hydraulic actuator 1 comprises at least one pump outlet plug 8 which makes it possible to prevent the hydraulic fluid expelled at the outlet 6 of the hydraulic positive displacement pump 4 from issuing into a low-pressure circuit 9 or into a reservoir 58 and to force it to be directed toward a high-pressure circuit 10 communicating with one or more hydraulic jacks 3 ensuring the opening of one or more valves 2 of the engine 12.

The hydraulic actuator 1 comprises at least one valve opening selector 11 which makes it possible to direct, via the high-pressure circuit 10, the hydraulic fluid expelled at the outlet 6 of the hydraulic positive displacement pump 4 toward the hydraulic jack 3 of at least one valve 2, in order to allow the opening of the latter, while at the same time preventing said hydraulic fluid from being directed toward one or more other valves 2 to remain closed.

The hydraulic actuator 1 comprises at least one opening nonreturn valve 24 which is located on the high-pressure circuit 10 between the pump outlet 6 and the hydraulic jack 3 of at least one valve 2 and which makes it possible to retain the hydraulic fluid in said hydraulic jack 3 of said valve 2 in order to keep it open.

The hydraulic actuator 1 comprises at least one valve closing selector 25 which makes it possible to direct the hydraulic fluid contained in the hydraulic jack 3 of at least one valve 2 kept open by the opening nonreturn valve 24 toward the inlet or inlets 7 of the hydraulic positive displacement pump 4, in order to ensure the closing of said valve or valves 2 and to prevent the hydraulic fluid contained in their hydraulic jack 3 from being introduced into the hydraulic jack 3 of another valve or other valves 2 which is/are to remain in a closed position.

Figure 8:
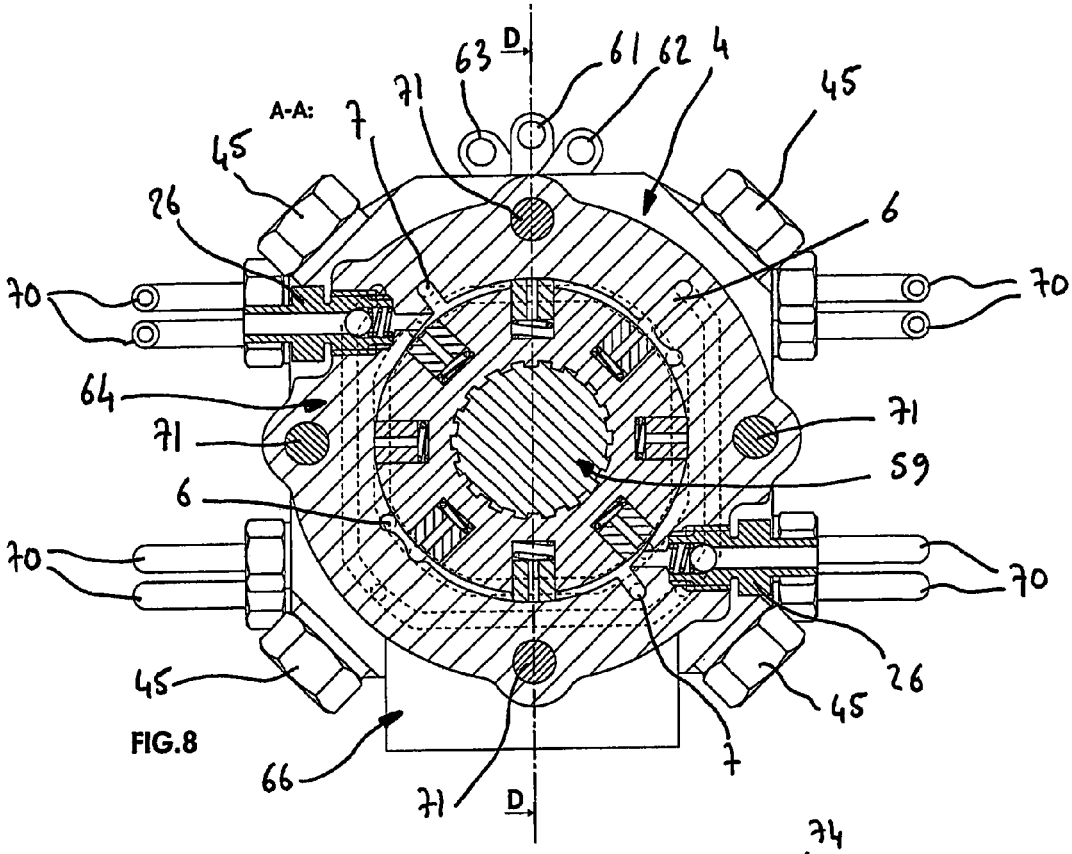
FIG. 8 is a sectional view showing the inlets and outlets of the hydraulic pump of the hydraulic actuator according to the present invention.

The hydraulic actuator 1 comprises at least one pump inlet nonreturn valve 26 which makes it possible for the hydraulic fluid of the low-pressure circuit 9 or of the reservoir 58 to be admitted at the inlet or inlets 7 of the hydraulic positive displacement pump 4 when the pressure of said low-pressure circuit 9 or of said reservoir 58 is higher than that of said inlet or inlets 7 of the hydraulic positive displacement pump 4 (FIG. 8).

It is noted that at least one of the valves 2 is equipped with a measuring device emitting an electrical or electromagnetic signal which informs a computer of the lift height of the valve at a given moment.

As regards the low-pressure circuit 9, the latter is connected to the pressurized lubrication circuit 15 of the engine 12. The low-pressure circuit 9 may also be provided independently of the pressurized lubrication circuit 15 of the engine 12.

Should the low-pressure circuit 9 be independent of the pressurized lubrication circuit 15 of the engine 12, the latter can be maintained at a pressure higher than the atmospheric pressure by means of an additional pump 13. The low-pressure circuit 9 may then comprise a pressure accumulator 14.

Figure 22:
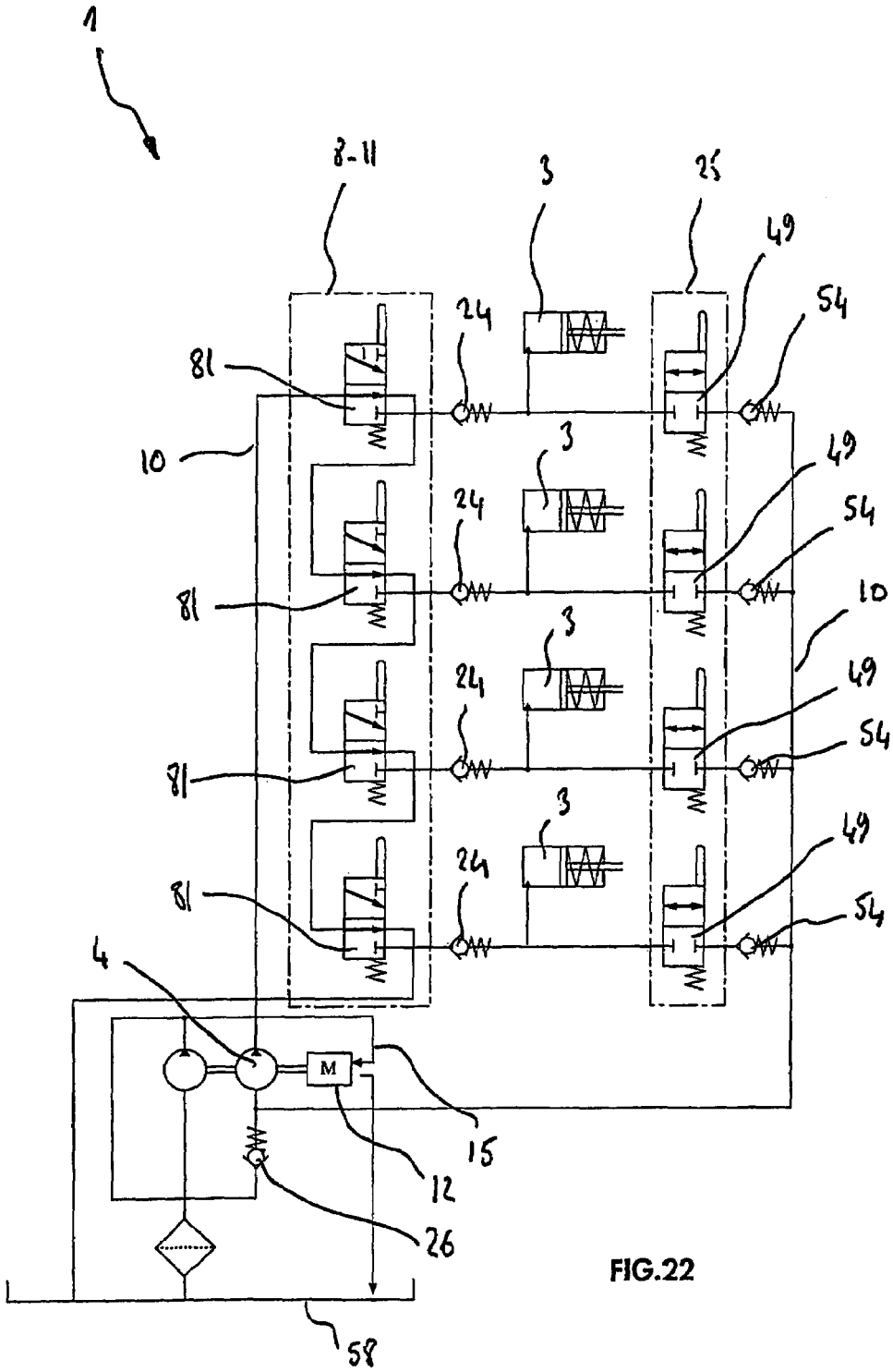
FIG. 22 is a diagrammatic illustration of a circuit, the functioning of which is identical to the preceding one shown in FIGS. 1 to 3, but of which the pump outlet plug and the valve opening selector are gathered together in a single combined distributor.

According to a particular embodiment, the pump outlet plug 8 and the valve opening selector 11 can be gathered together in a single combined distributor 81 comprising at least one inlet connected to the outlet 6 of the hydraulic positive displacement pump 4 and capable of being put into relation either with an outlet connected to the low-pressure circuit 9 or with an outlet connected to at least one hydraulic jack 3 (FIG. 22).

FIGS. 4 to 7 show the hydraulic valve actuator for reciprocating engines, of which the cylinder and the chamber 20 of the hydraulic jack 3 ensuring the opening of the valve or valves 2 are arranged in a valve guide 16, said cylinder and said chamber 20 cooperating with a jack piston consisting of a shoulder 19 arranged on the valve stem 18 in order to open the valve 2.

The jack piston consisting of a shoulder 19 arranged on the valve stem 18 participates in guiding the valve 2 in the valve guide 16.

The jack piston consisting of the shoulder 19 on the valve stem 18 comprises at least one seal 17.

Figure 5:
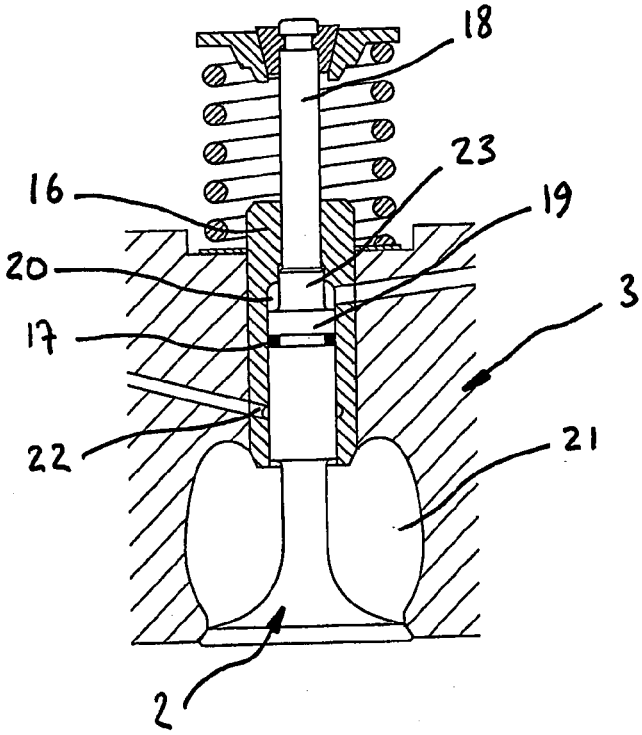
FIGS. 5 to 7 are views illustrating in detail the valves of an engine controlled by the hydraulic actuator according to the present invention.
Figure 6:
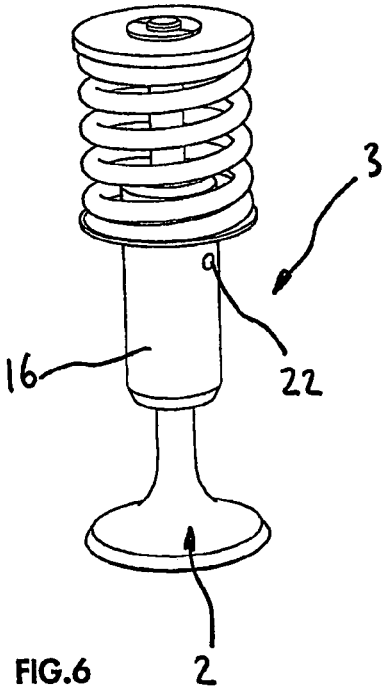
Figure 7:
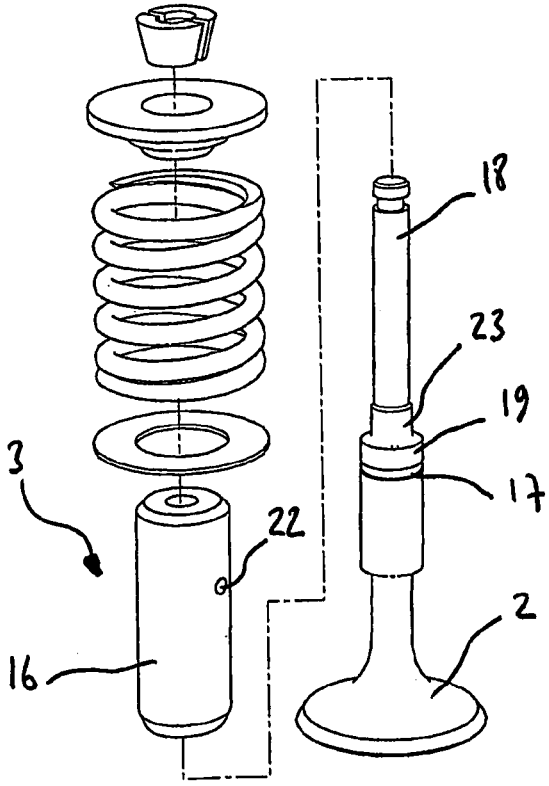

The valve guide 16 comprises at least one drain 22 in the vicinity of the intake or exhaust duct 21, which the cylinder head of the engine 12 comprises in order to limit the passage of the hydraulic fluid toward said intake or exhaust duct 21 (FIG. 5).

The hydraulic jack 3 ensuring the opening of the valve or valves 2 comprises a limit-stop damping device making it possible to brake the valve or valves 2 before they come into contact with their seat.

Thus, the hydraulic jack 3 arranged in the valve guide 16 comprises a limit-stop damping device which consists of a small shoulder 23 which is arranged on the valve stem 18.

The shoulder 23 cooperates with a cylinder portion of small height and of a diameter substantially larger than said shoulder 23, said cylinder portion being arranged in the upper part of the valve guide 16 in order to shear the hydraulic fluid when the valve 2 reaches the end of the closing stroke, the effect of which is to reduce the speed of said valve 2.

The hydraulic jack 3 ensuring the opening of at least one valve 2 comprises, in the region of its chamber 20, a bleeding device which consists of a plug which can be opened by means of a command in order to make it possible for the hydraulic fluid contained in said chamber 20 to escape toward a low-pressure circuit.

FIG. 8 shows the hydraulic positive displacement pump 4 which may be a vane pump, the stator of which has an inner profile which defines at least one inlet and one outlet which are independent.

In a first variant, the hydraulic positive displacement pump 4 may be a gear pump comprising at least two pinions and at least one inlet and one outlet which are independent.

In a second variant, the hydraulic positive displacement pump 4 may be a variable displacement pump which makes it possible to vary the lifting speed of the valve or valves 2 of the engine 12 under given operating conditions of said engine.

Figure 11:
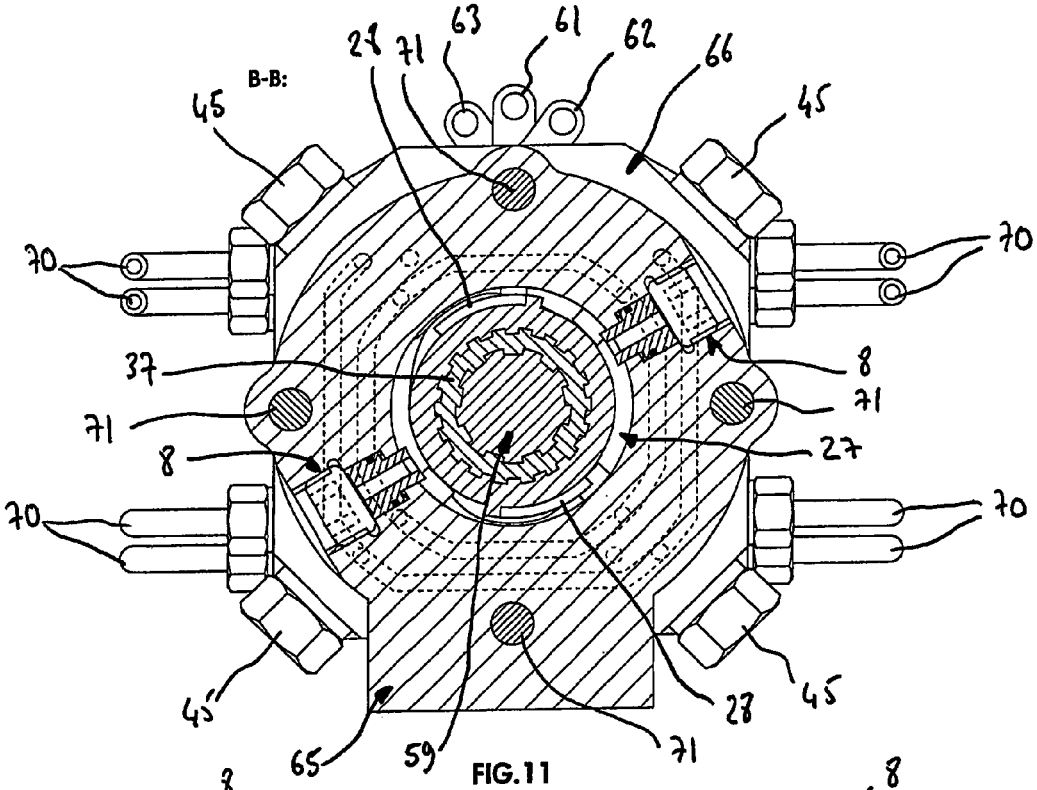
FIGS. 11 to 13 are views illustrating the pump outlet plugs of the hydraulic actuator according to the present invention.
Figure 12:
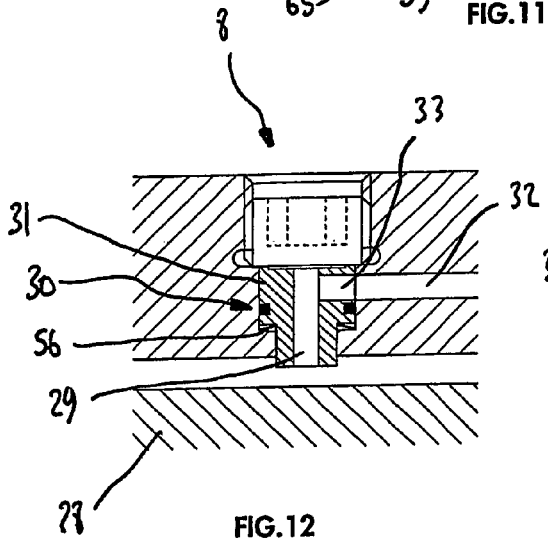
Figure 13:
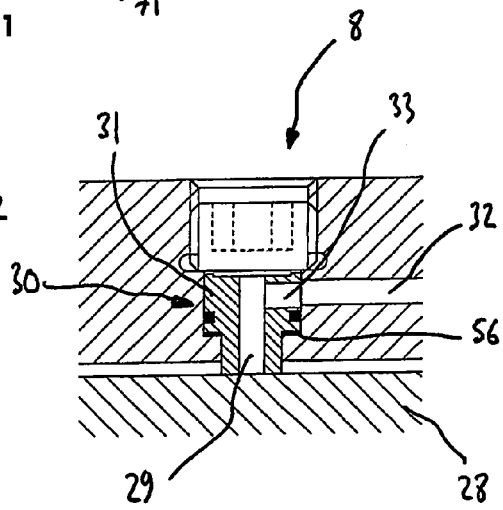
Figure 14:
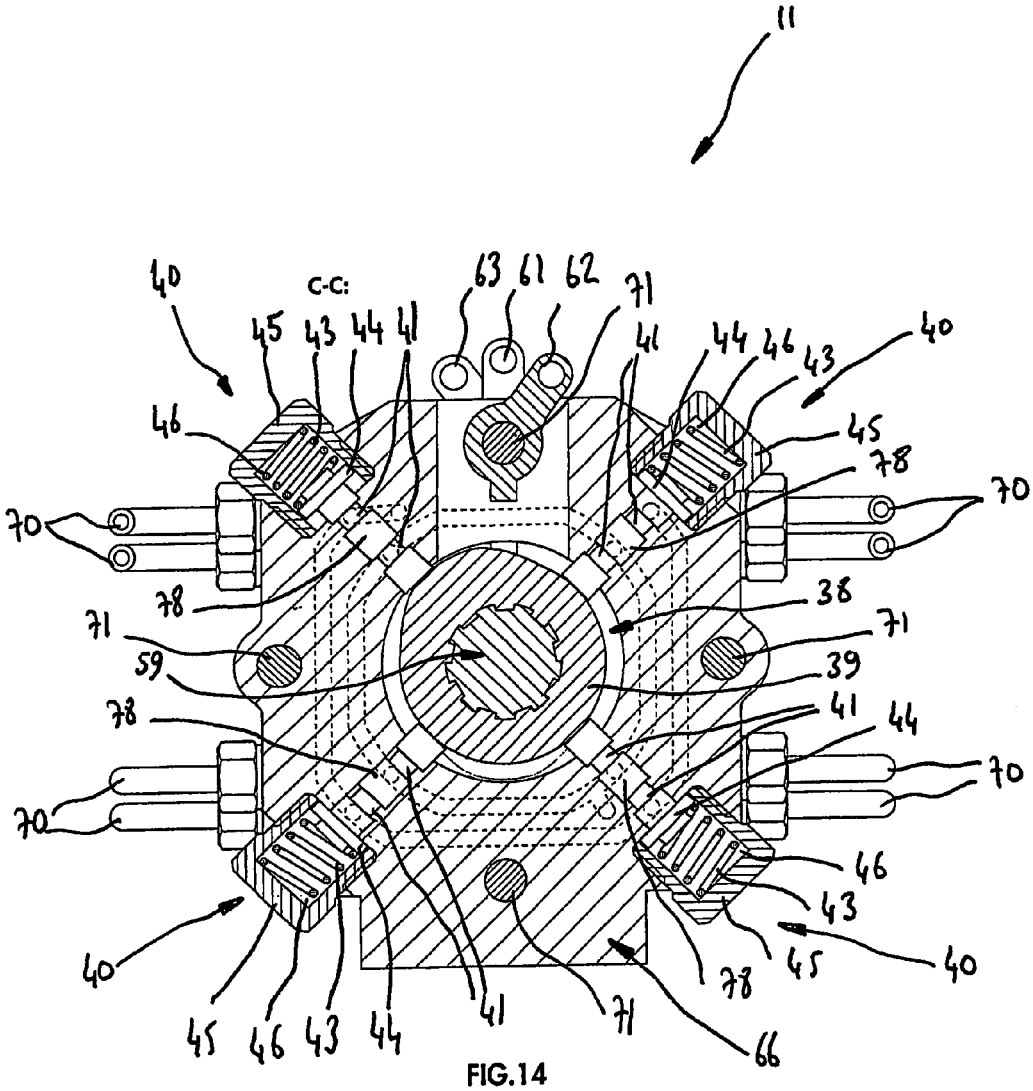
FIG. 14 is a sectional view showing the valve opening selector of the hydraulic actuator according to the present invention.
Figure 15:
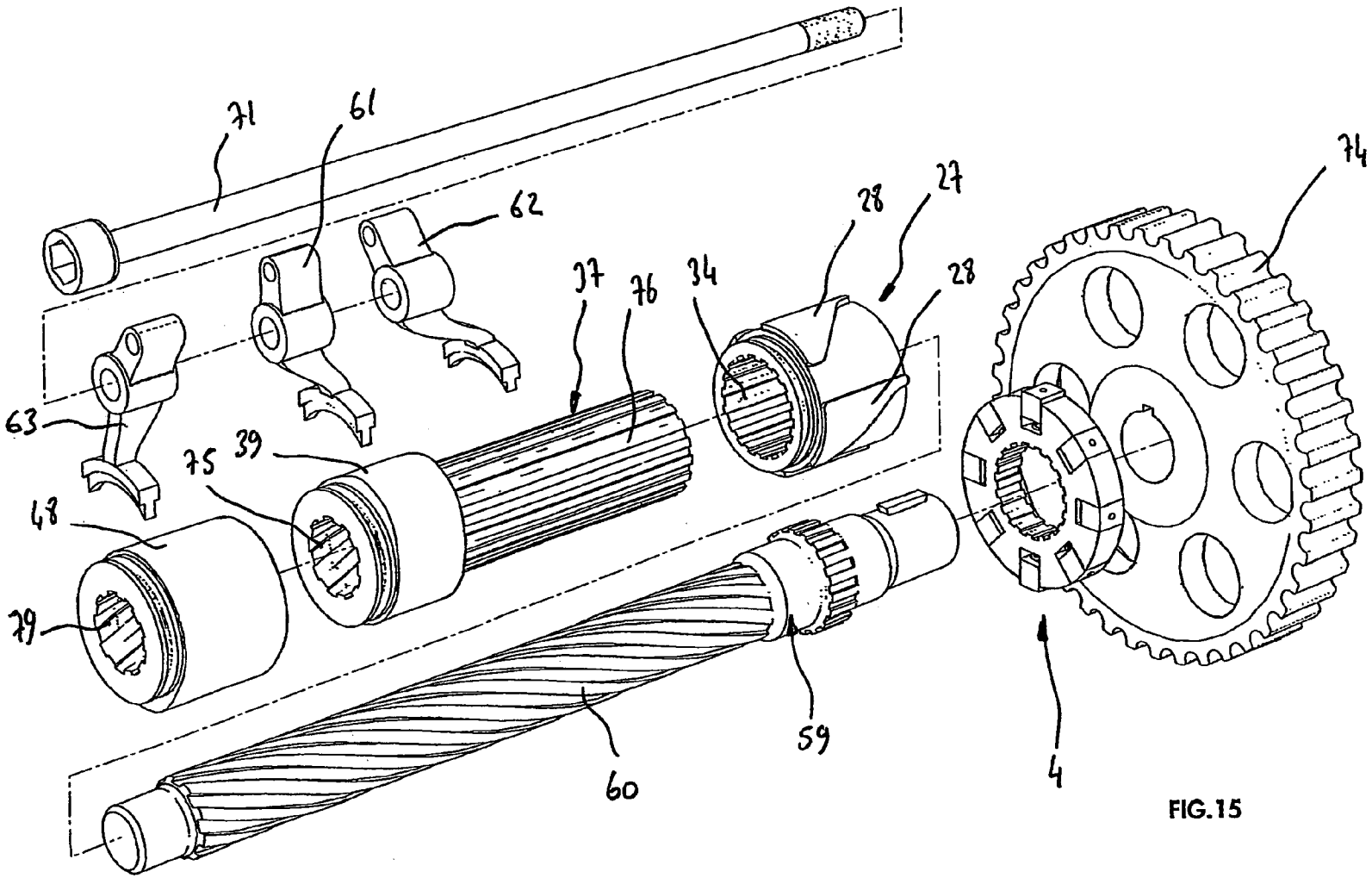
FIGS. 15 to 21 are views illustrating the assembling of the various component elements of the hydraulic actuator according to the present invention.
Figure 16:
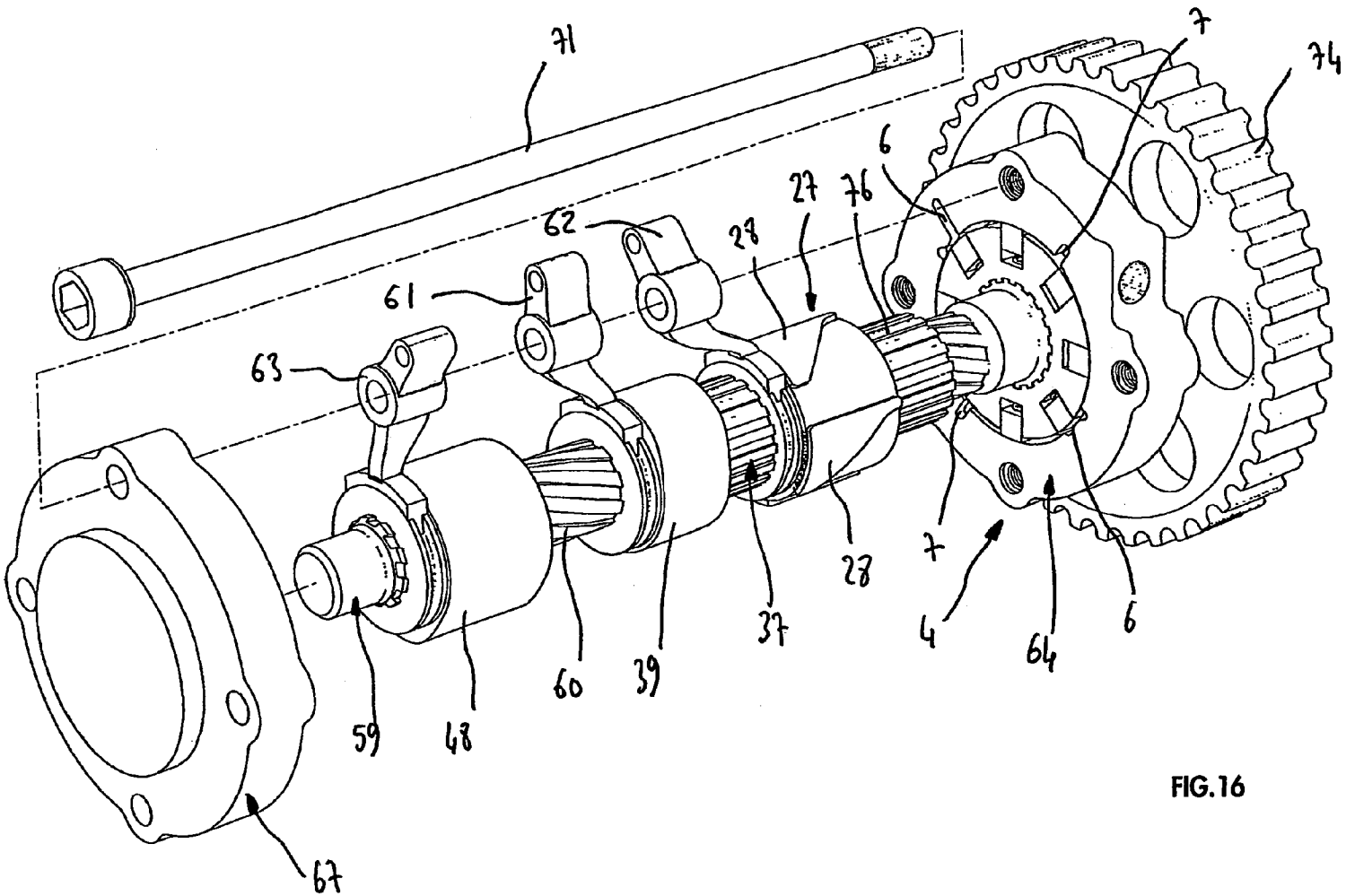
Figure 17:
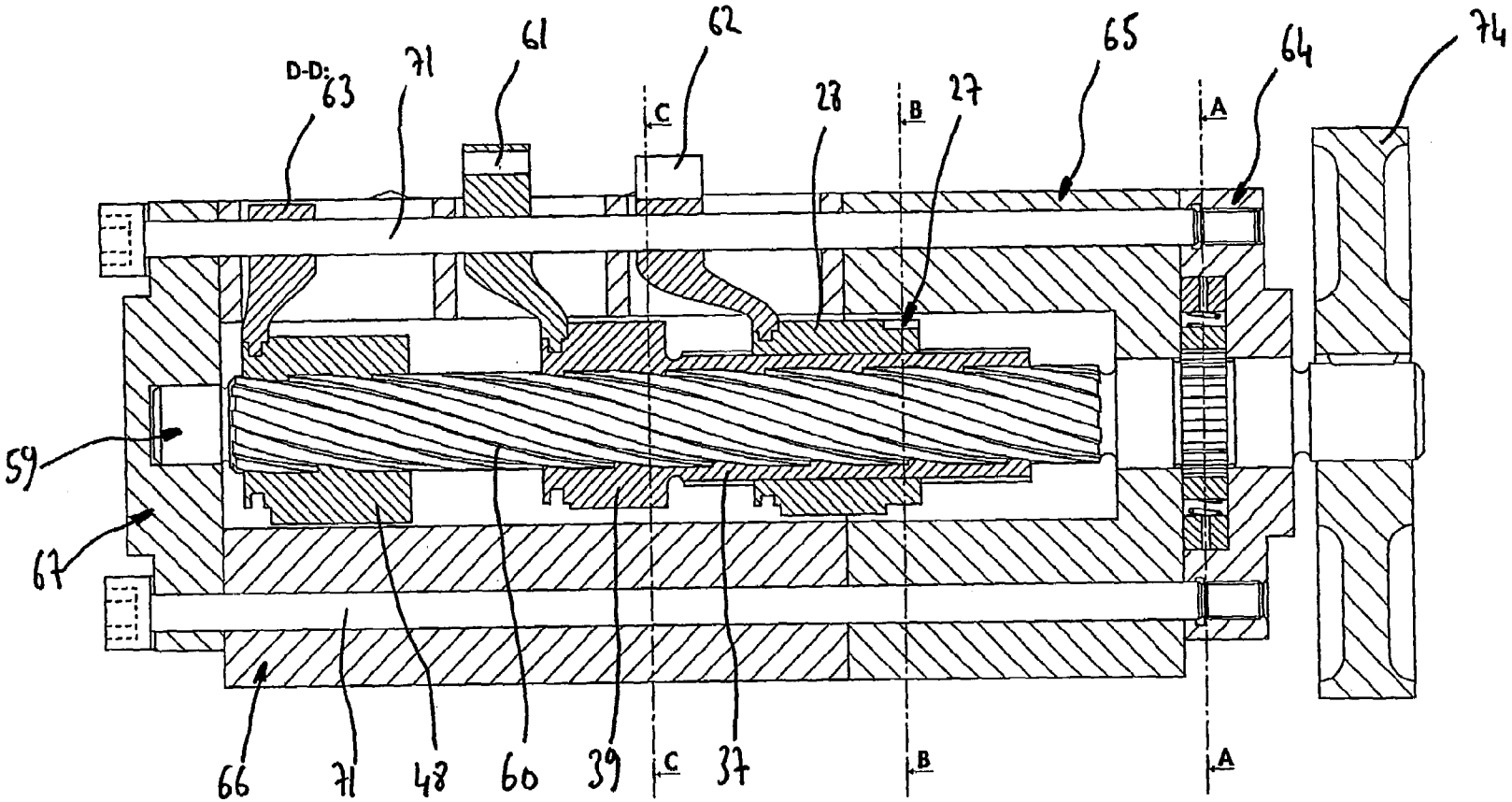
Figure 18:
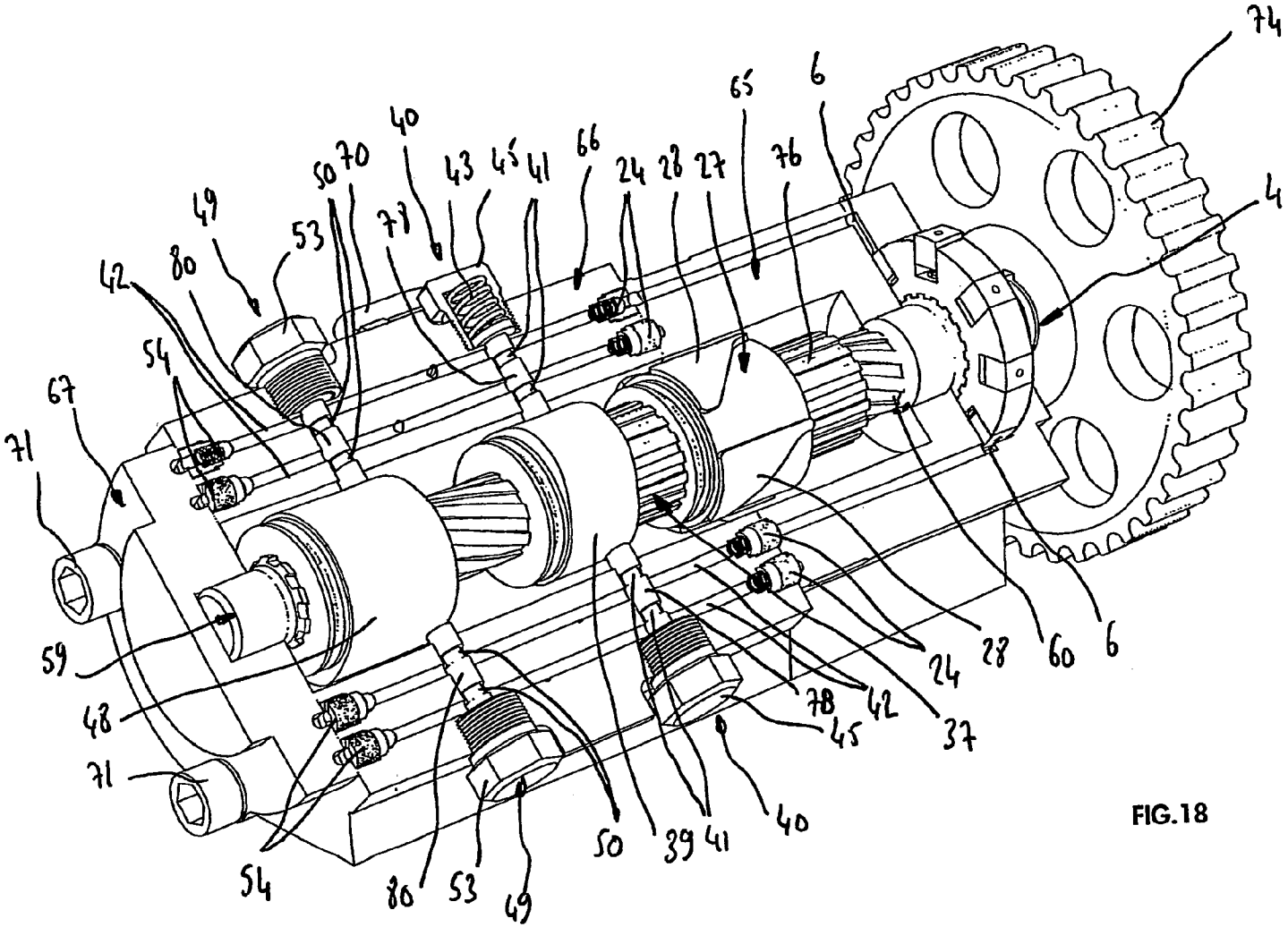
Figure 19:
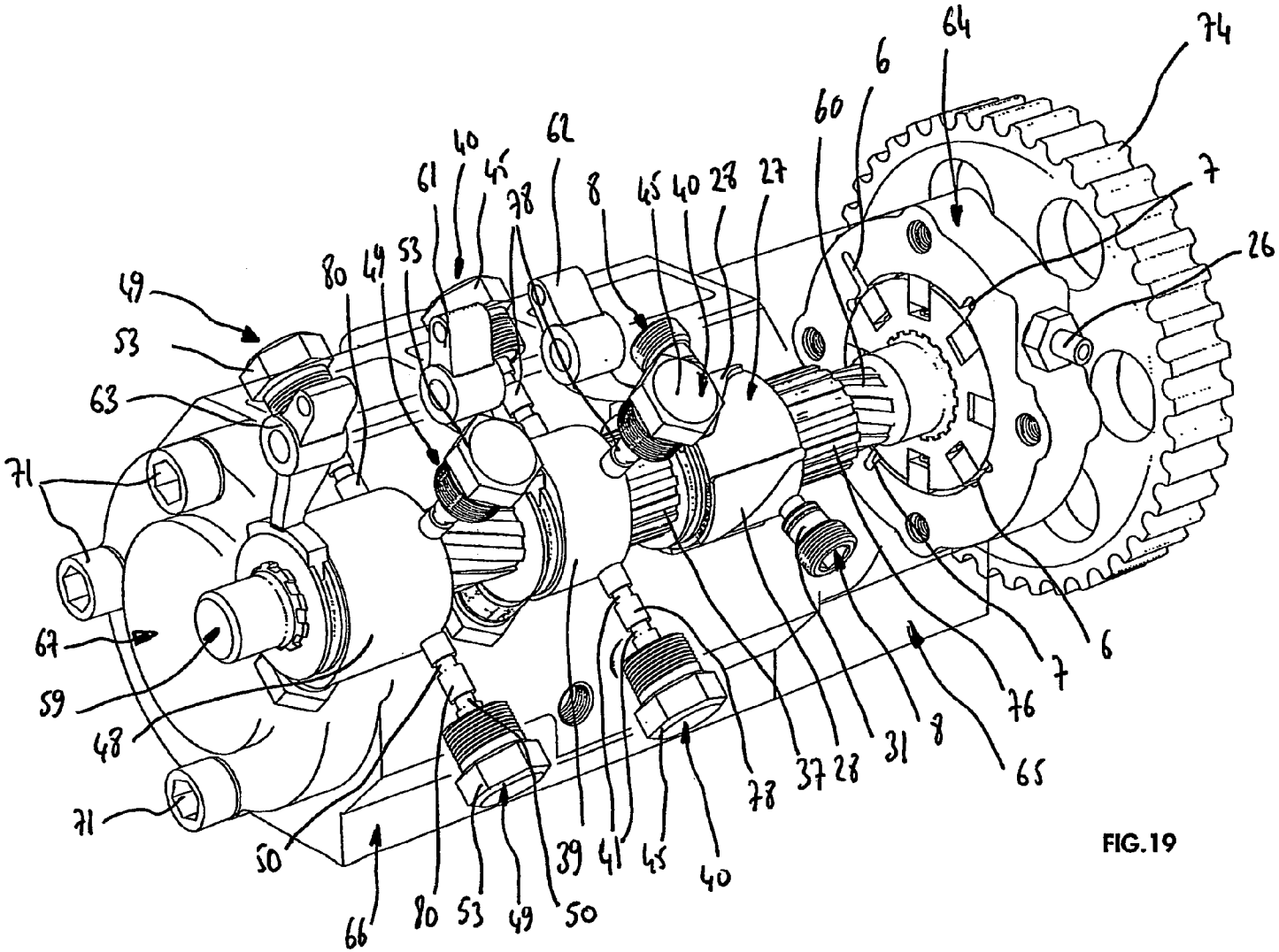

FIGS. 11 to 13 illustrate an exemplary embodiment of the pump outlet plug 8.

In another example, the pump outlet plug 8 would be a solenoid valve controlled by a computer.

In the example shown in FIGS. 11 to 13, the pump outlet plug 8 is a rotary mechanical device contained in a plug housing 65 and rotating at a speed proportional to that of the crankshaft 5 of the engine 12, and comprising a plug rotor 27 equipped with at least one protuberance 28 periodically plugging one or more pump outlet ports 29 accommodated in said plug housing 65 during the rotation of said plug rotor 27.

It is noted that the leaktightness between the pump outlet port or ports 29 and the protuberances 28 of the plug rotor 27 is reinforced by a device 30 for keeping said pump outlet port or ports 29 in contact with said protuberances 28 when the latter are positioned opposite said pump outlet port or ports 29.

The device 30 for keeping in contact consists of a plug piston 31 which is positioned radially in the plug housing 65 and which comprises a pump outlet port 29 which passes right through it longitudinally.

The pump outlet port 29 is connected to a pump outlet duct 32 by means of a radial port 33. The plug piston 31 comprises a concave cylindrical bearing face having a radius substantially identical to that of the protuberances 28, so as to have a wide contact surface with said protuberances 28.

The plug piston 31 has, on the side of the plug housing 65, a surface subjected to the pressure of the hydraulic fluid which is greater than the contact surface which it has with the protuberances 28, so that said plug piston is kept in contact with said protuberances when the pressure of the fluid increases in the pump outlet duct 32 during the passage of said protuberances 28 (FIG. 13).

When there is no protuberance plugging the pump outlet port 29 of the plug piston 31, the latter is kept in bearing contact on the plug housing 65 by means of a spring 56 (FIG. 12).

The plug piston 31 comprises at least one seal ensuring leaktightness between said plug piston and the bore in which it is accommodated.

FIGS. 11 and 15 to 19 illustrate the plug rotor 27 which is equipped with a device for angular phase shift with respect to the crankshaft 5 of the engine 12, so that the opening of the valve or valves 2 can be advanced or retarded.

In a variant which is not illustrated, the phase-shifting device of the plug rotor 27 consists of at least one helical spline arranged on the inside of said rotor and cooperating with at least one helical spline arranged on the outside of the driveshaft of said plug rotor.

In this variant, the phase shift takes place by means of the translation of the plug rotor 27 parallel to its axis of rotation by means of a fork.

According to this variant, the plug rotor 27 comprises protuberances which are of sufficient width to plug the pump outlet port or ports accommodated in the plug housing 65, whatever their longitudinal position with respect to the latter.

In our exemplary embodiment according to FIGS. 11 and 15 to 19, the protuberances 28 are provided so as to be wide and of variable cross section over the length of the plug rotor 27, so that they have a plugging time which varies as a function of the longitudinal position of the plug rotor 27 with respect to the pump outlet port or ports 29, thus making it possible to increase or reduce the lift stroke of the valve or valves 2.

The longitudinal position of the plug rotor 27 with respect to said pump outlet port or ports 29 is controlled by means of a valve lift fork 62 which makes it possible to impart to said plug rotor 27 a translation parallel to its axis of rotation.

It is noted that the plug rotor 27 comprises at least one straight inner spline 34 cooperating with at least one straight outer spline 76 provided on an opening sleeve 37 or on any other drive element.

The angular phase-shifting device of the plug rotor 27 consists of the opening sleeve 37 comprising at least one inner helical spline 75 cooperating with at least one outer helical spline 60 which its driveshaft 59 or any other drive means comprises.

The opening sleeve 37 likewise comprises at least one straight outer spline 76 cooperating with at least one straight inner spline 34 provided on the plug rotor 27.

The opening sleeve 37 can be actuated in terms of translation parallel to its axis of rotation by means of a valve opening advance fork 61, in order to advance or retard the opening of the valve or valves 2 by means of the angular phase shift of the plug rotor 27 which said opening sleeve drives in rotation.

The lift of the valve or valves 2 is controlled independently by means of the valve lift fork 62 which acts on the longitudinal position of the plug rotor 27 with respect to the pump outlet port or ports 29.

It is noted that, in an alternative embodiment which is not illustrated, the plug rotor 27 may comprise at least one straight inner spline cooperating with at least one straight outer spline provided on its driveshaft or on any other drive element.

FIGS. 14 to 19 illustrate an example of a valve opening selector 11 which may be a rotary mechanical device contained in a housing and rotating at a speed proportional to that of the crankshaft 5 of the engine 12.

Alternatively, the valve opening selector 11 may consist of one or more solenoid valves controlled by a computer.

According to the example illustrated in FIGS. 14 to 19, the valve opening selector 11 is a rotary mechanical device contained in a selector housing 66, rotating at a speed proportional to that of the crankshaft 5 of the engine 12 and comprising an opening selector rotor 38 equipped with a cam 39 which actuates one or more valve opening distributors 40 arranged radially in the selector housing 66.

The opening selector rotor 38 is equipped with a device for opening angular phase shift with respect to the crankshaft 5 of the engine 12, so that the valve opening selector 11 can be synchronized with the pump outlet plug 8 and can select the valve or valves 2 at the desired moment.

The opening selector rotor 38 comprises a cam 39 which is integral with the opening sleeve 37, thus making it possible for the valve opening selector 11 to remain synchronized with the opening of the valve or valves 2 which depends on the angular phase shift of the plug rotor 27 with respect to the crankshaft 5 of the engine 12.

The valve opening advance fork 61 makes it possible, simultaneously and in the same proportions, to shift the phase of the opening selector rotor 38 and the plug rotor 27 with respect to the crankshaft 5.

The angular phase-shifting device of the opening selector rotor 38 consists of at least one helical spline 77 arranged on the inside of said opening selector rotor 38 and cooperating with at least one helical spline 60 arranged on the outside of the driveshaft 59 of said opening selector rotor 38 or of any other drive means.

The phase shift takes place by means of a fork as a result of the translation of said opening selector rotor 38 parallel to its axis of rotation.

The cam 39 is provided with sufficient width to actuate the valve opening distributors 40, whatever its longitudinal position with respect to said distributors.

The valve opening distributor or distributors 40 consist of a cylindrical piece 78 equipped with one or more grooves 41 and accommodated in a bore arranged in the selector housing 66.

The groove or grooves 41 are brought, by means of the axial translation of the cylindrical piece 78 imparted by the cam 39, level with ducts 42 arranged in the selector housing 66, in order to make it possible for the hydraulic fluid to circulate in said ducts.

When the cam 39 does not actuate them, the cylindrical pieces 78 are kept at the desired distance from the opening selector rotor 38 by the twin action of a shoulder 44 arranged on said cylindrical pieces 78 and bearing on the selector housing 66 and of a spring 43 kept compressed by a cap 45 screwed into said housing.

The cap 45 screwed in the selector housing 66 defines a chamber 46 which contains the spring 43 and which is connected to the low-pressure circuit 9 or to the reservoir 58 by means of a duct, not illustrated.

FIGS. 15 to 21 show an exemplary embodiment of a valve closing selector 25 which consists of a rotary mechanical device contained in a selector housing 66 and rotating at a speed proportional to that of the crankshaft 5 of the engine 12.

Alternatively, the valve closing selector 25 may consist of one or more solenoid valves controlled by a computer.

The valve closing selector 25 comprises a closing selector rotor 47 equipped with a cam 48 which actuates one or more valve closing distributors 49 arranged radially in the selector housing 66.

The closing selector rotor 47 is equipped with a device for angular phase shift with respect to the crankshaft 5 of the engine 12, so that the closing of the valve or valves 2 can be advanced or retarded.

The phase-shifting device of the closing selector rotor 47 consists of at least one helical spline 79 arranged on the inside of the closing selector rotor 47 and cooperating with at least one helical spline 60 arranged on the outside of the driveshaft 59 or of any other drive means of said closing selector rotor 47.

The phase shift takes place by means of the translation of the closing selector rotor 47 parallel to its axis of rotation by means of a valve closing retard fork 63.

The cam 48 is of sufficient width to actuate the valve closing distributors 49, whatever its longitudinal position with respect to the latter.

The valve closing distributor or distributors 49 consist of a cylindrical piece 80 equipped with one or more grooves 50 and accommodated in a bore arranged in the selector housing 66.

The grooves 50 are brought, by means of the axial translation of the cylindrical piece 80 imparted by the cam 38, level with ducts arranged in the selector housing 66, in order to make it possible for the hydraulic fluid to circulate in said ducts.

When the cam 48 does not actuate them, the cylindrical pieces 80 are kept at the desired distance from the closing selector rotor 47 by the twin action of a shoulder 51 arranged on said cylindrical pieces 80 and bearing on the selector housing 66 and of a spring 52 kept compressed by a cap 53 screwed into said housing.

The cap 53 screwed into the selector housing 66 defines a chamber 73 which contains the spring 52 and which is connected to the low-pressure circuit 9 or to the reservoir 58 by means of a duct, not illustrated.

The high-pressure circuit 10 comprises at least one closing nonreturn valve 54 upstream or downstream of the valve closing selector 25, in order to prevent the hydraulic fluid contained in the hydraulic jack 3 of one or more valves 2 in the closing phase from being capable of being introduced into the hydraulic jack 3 of another valve or other valves 2 which are to remain closed.

The closing nonreturn valve 54 positioned upstream or downstream of the valve closing selector 25 consists of a ball kept on its seat by means of a spring.

It is also noted that the pump inlet nonreturn valve 26 consists of a ball kept on its seat by means of a spring.

Figure 20:
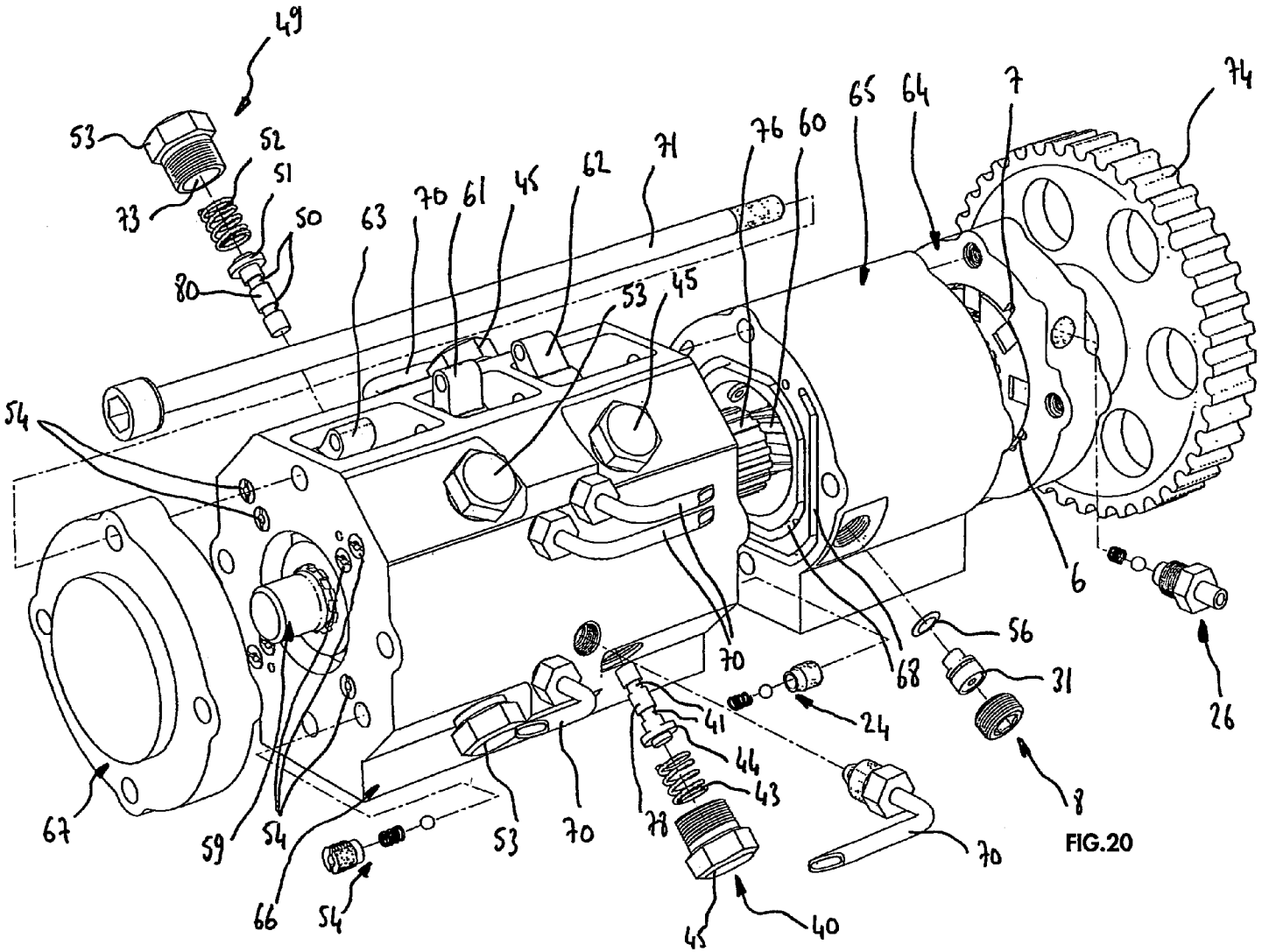
Figure 21:
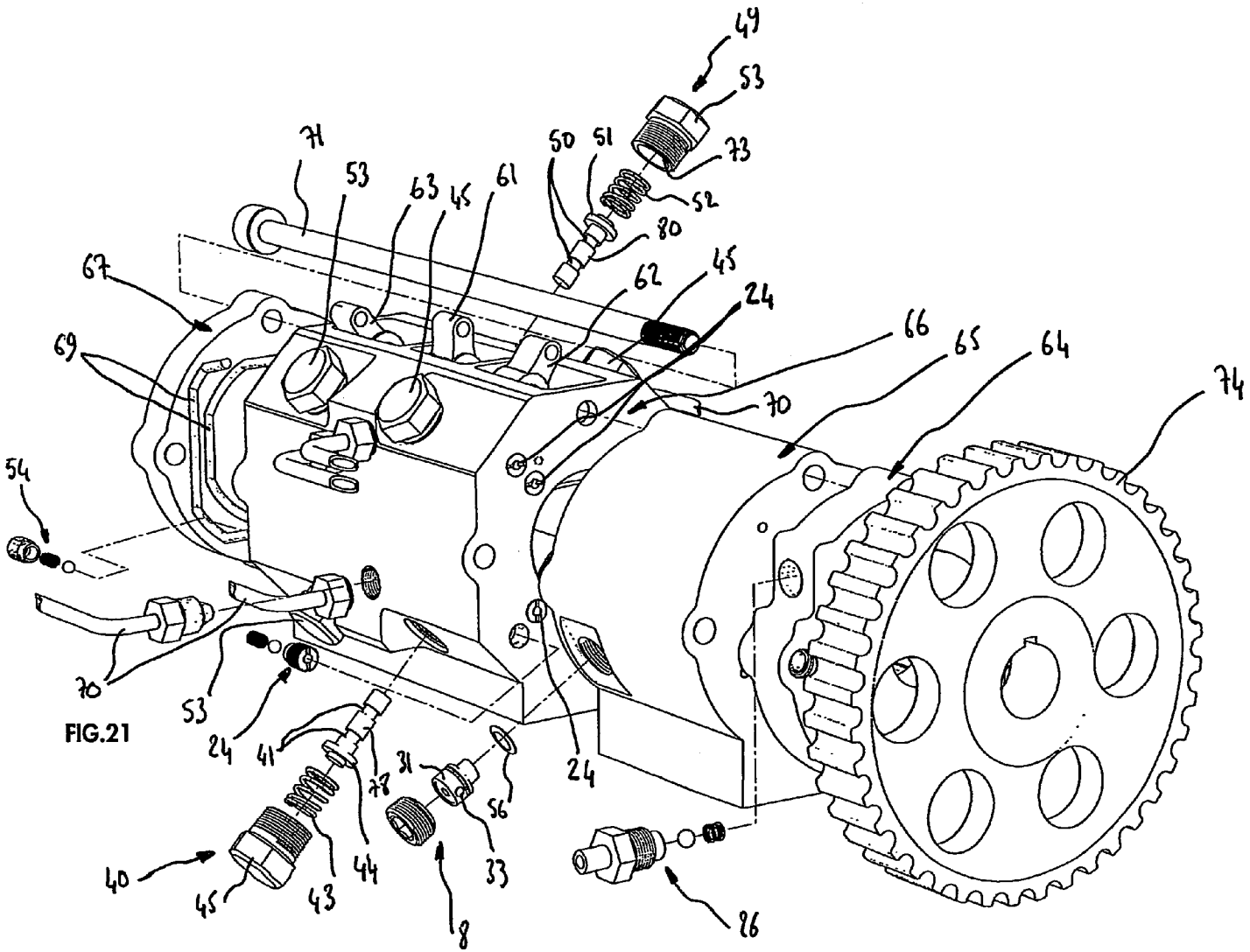

FIGS. 20 and 21 illustrate a common housing consisting of one or more parts which contain together or in groups, as components, the hydraulic positive displacement pump 4, the pump outlet plug 8, the valve opening selector 11, the opening nonreturn valve or valves 24, the valve closing selector 25 and the closing nonreturn valve or valves 54.

The hydraulic positive displacement pump 4, the plug rotor 27, the selector rotor 38 and the closing selector rotor 47 or any combination of these four devices are driven in rotation by means of a common shaft 59, itself driven in rotation by the crankshaft 5 of the engine 12 by means of a transmission device (FIGS. 15 to 19).

The transmission device driving the common shaft 59 consists of a pulley 74 driven in rotation by the crankshaft 5 of the engine 12 by means of a notched belt or a chain or a gear system consisting of at least one pinion.

The common shaft 59 is equipped with at least one helical spline 60 which drives in rotation the plug rotor 27, the opening selector rotor 38, the opening sleeve 37 and the closing selector rotor 47 or any combination of these three devices and cooperates with the inner helical splines of some of these devices in order to allow their angular phase shift with respect to the crankshaft 5 of the engine 12.

The common housing consists of four main housings which contain the common shaft 59 and which are assembled end to end, with respectively:

- a pump housing 64 comprising the hydraulic positive displacement pump 4 and the pump inlet nonreturn valve or valves 26,
- a plug housing 65 containing the plug rotor 27 and the pump outlet port or ports 29,
- a selector housing 66 containing the valve lift fork 62, the opening selector rotor 38, the valve opening distributor or distributors 40, the valve opening advance fork 61, the closing selector rotor 47, the valve closing distributor or distributors 49, the valve closing retard fork 63 and the opening nonreturn valve or valves 24 and capable of comprising the closing nonreturn valve or valves 54,
- and a closing collector housing 67.

The plug housing 65 has passing through it ducts connecting the outlet or outlets 6 of the hydraulic positive displacement pump 4 to the pump outlet plug or plugs 8, on the one hand, and to an opening collector 68 consisting of a network of ducts which is arranged at the parting plane between the plug housing 65 and the selector housing 66, on the other hand.

The plug housing 65 has passing through it conduits connecting the inlet or inlets 7 of the hydraulic positive displacement pump 4 to a closing collector 69 consisting of a network of ducts which is arranged at the parting plane between the selector housing 66 and the closing collector housing 67.

The selector housing 66 has passing through it longitudinally ducts 42 which connect the opening collector 68 and the closing collector 69 and which can be shut off or opened by means of the valve opening distributor or distributors 40 and by means of the valve closing distributor or distributors 49.

The ducts 42 comprise valve outgoing ducts 70 which are located between the valve opening distributor or distributors 40 and the valve closing distributor or distributors 49 and which are connected to the hydraulic jack 3 of the valve or valves 2.

The selector housing 66 likewise has passing through it longitudinally one or more ducts which connect the closing collector 69 to the inlet or inlets 7 of the hydraulic positive displacement pump 4.

The opening collector 68 makes it possible to connect to one another the ducts which pass longitudinally through the selector housing 66 and which are to be connected to the same pump outlet 6.

The pump outlet 6 is connected to the opening collector 68 by means of a duct which passes through the plug housing 65.

The closing collector 69 makes it possible to connect to one another the ducts which pass longitudinally through the selector housing 66 and which are to be connected to the same pump inlet 7.

The pump inlet 7 is connected to the closing collector 69 by means of the ducts which pass respectively through the selector housing 66 and the plug housing 65.

Assembly screws 71 pass right through the various housings 64, 65, 66 and 67 in order to keep them assembled, one or more of said assembly screws 71 being capable of serving as slideway for the forks 61, 62 and 63 which make it possible to control the opening, lift and closing of the valves 2.

The valve opening advance fork 61, the valve lift fork 62 and the valve closing retard fork 63 are actuated in terms of translation by means of electric motors controlled by a computer and connected to said forks 61, 62 and 63 by transmission means.

The pump outlet port or ports 29 which the protuberances 28 of the plug rotor 27 shut off issue on the inside of the common housing which comprises, in particular, the common shaft 59, said common housing forming a closed chamber connected:

- to the engine lubricating oil housing 72 by means of a duct,
- or to the pressurized lubrication circuit 15 of the engine 12,
- or to a hydraulic fluid housing independent of the engine lubricating oil housing 72,
- or kept under pressure by the additional pump 13.

It is noted that, according to a particular embodiment, the same duct connected to the high-pressure hydraulic circuit 10 can simultaneously feed a plurality of hydraulic jacks 3 via a flow divider which ensures that the valves 2 actuated by said hydraulic jacks 3 have a substantially identical lift.

The functioning of the device according to the present invention is understood from the foregoing description.

FIG. 1 illustrates a basic diagram of the device in a configuration with four valves (for example in order to actuate the four intake or exhaust valves of a four-cylinder engine).

It can be seen there that, when no valve is to be opened by means of one or other of the hydraulic jacks 3, the hydraulic positive displacement pump 4 discharges hydraulic fluid coming from the low-pressure circuit 9, here the engine lubrication circuit, via the pump inlet nonreturn valve 26 and toward the engine lubricant housing 58 via the pump outlet plug 8 which is then open.

When a valve is to be opened, the valve opening selector 11 puts the hydraulic jack 3 of said valve in relation with the high-pressure circuit 10 coming from the outlet of the hydraulic positive displacement pump 4.

The pump outlet plug 8 then closes the pump outlet duct 32, thus raising the pressure in the high-pressure circuit 10 so that the hydraulic jack 3 opens the selected valve.

When the valve is lifted sufficiently, the pump outlet plug 8 reopens the pump outlet duct 32, thus stopping the lift of the valve, since the pressure of the high-pressure circuit 10 upstream of the opening nonreturn valve 24 becomes lower than that prevailing in the chamber of the hydraulic jack 3 due to the action of the return spring of the valve.

Said valve remains open due to the action of the opening nonreturn valve 24.

The closing of the valve is controlled by the valve closing selector 25 which, at the selected moment, puts the hydraulic jack 3 of said valve in relation with the inlet of the hydraulic positive displacement pump 4 via the high-pressure circuit 10.

The rapid rise in pressure of said high-pressure circuit 10, the result of which is to close the arrival of the hydraulic fluid coming from the engine lubrication circuit by means of the action of the pump inlet nonreturn valve 26 and to force the hydraulic fluid at the inlet of said hydraulic positive displacement pump 4, thus making it possible to recover a major part of the mechanical work absorbed as a result of the compression of the valve spring and to control the closing speed of said valve.

When the valve is rested on its seat, the hydraulic positive displacement pump 4 again discharges hydraulic fluid coming from the low-pressure circuit 9 toward the engine lubricant housing 58 via the pump inlet nonreturn valve 26.

It may be noted that the simultaneous opening and closing of two different valves are possible, in which case the inlet of the hydraulic positive displacement pump 4 is fed by means of the hydraulic jack 3 of one valve subjected to closing actuation, while the hydraulic fluid emerging from said hydraulic positive displacement pump 4 is forced by the pump outlet plug 8 to feed the hydraulic jack 3 of another valve subjected to opening actuation.

Figure 2:
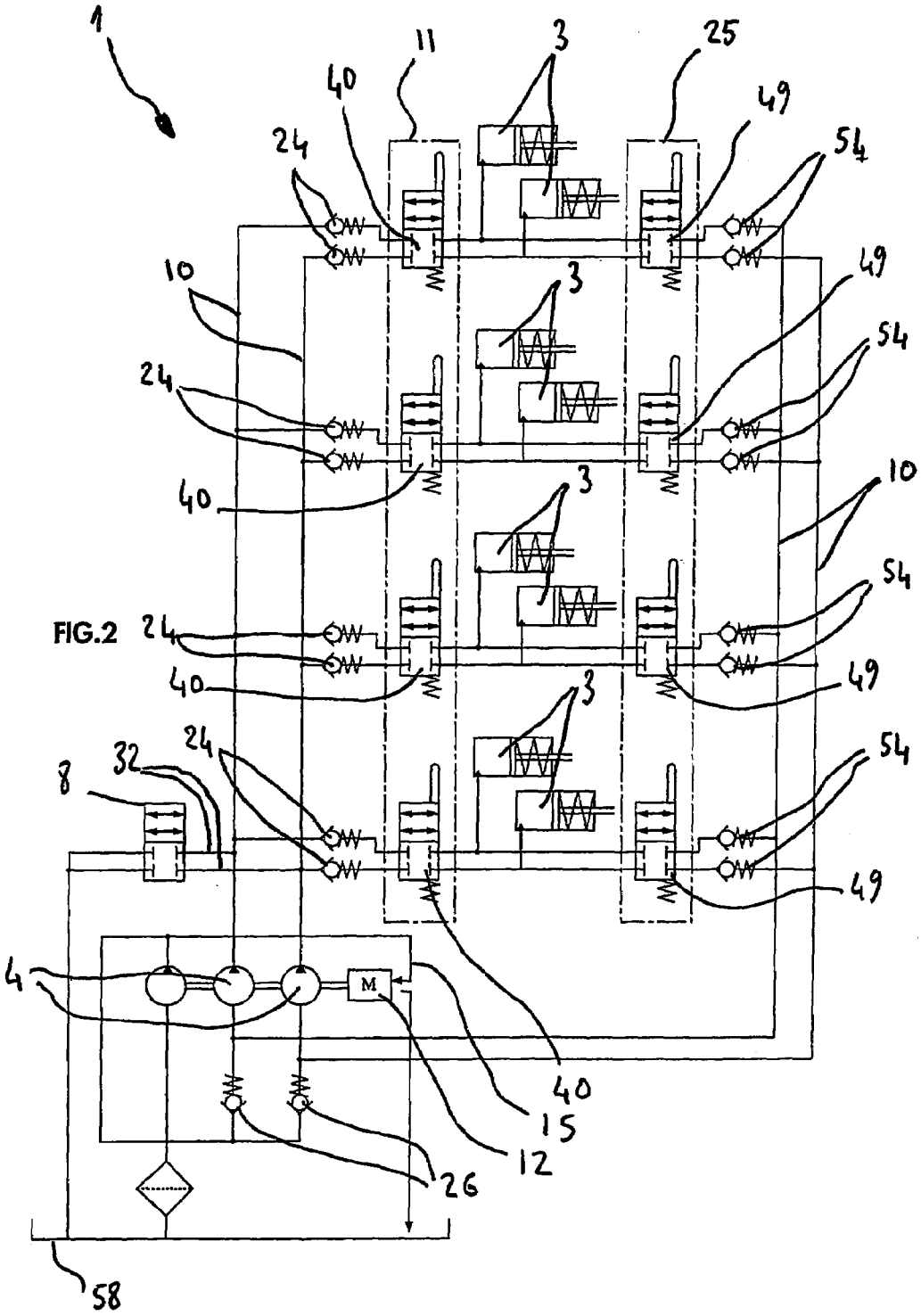
FIG. 2 is a diagrammatic illustration of a circuit, the functioning of which is identical to the preceding one, but which is intended, for example, for actuating the eight intake valves of a four-cylinder engine with two intake valves per cylinder.
Figure 3:
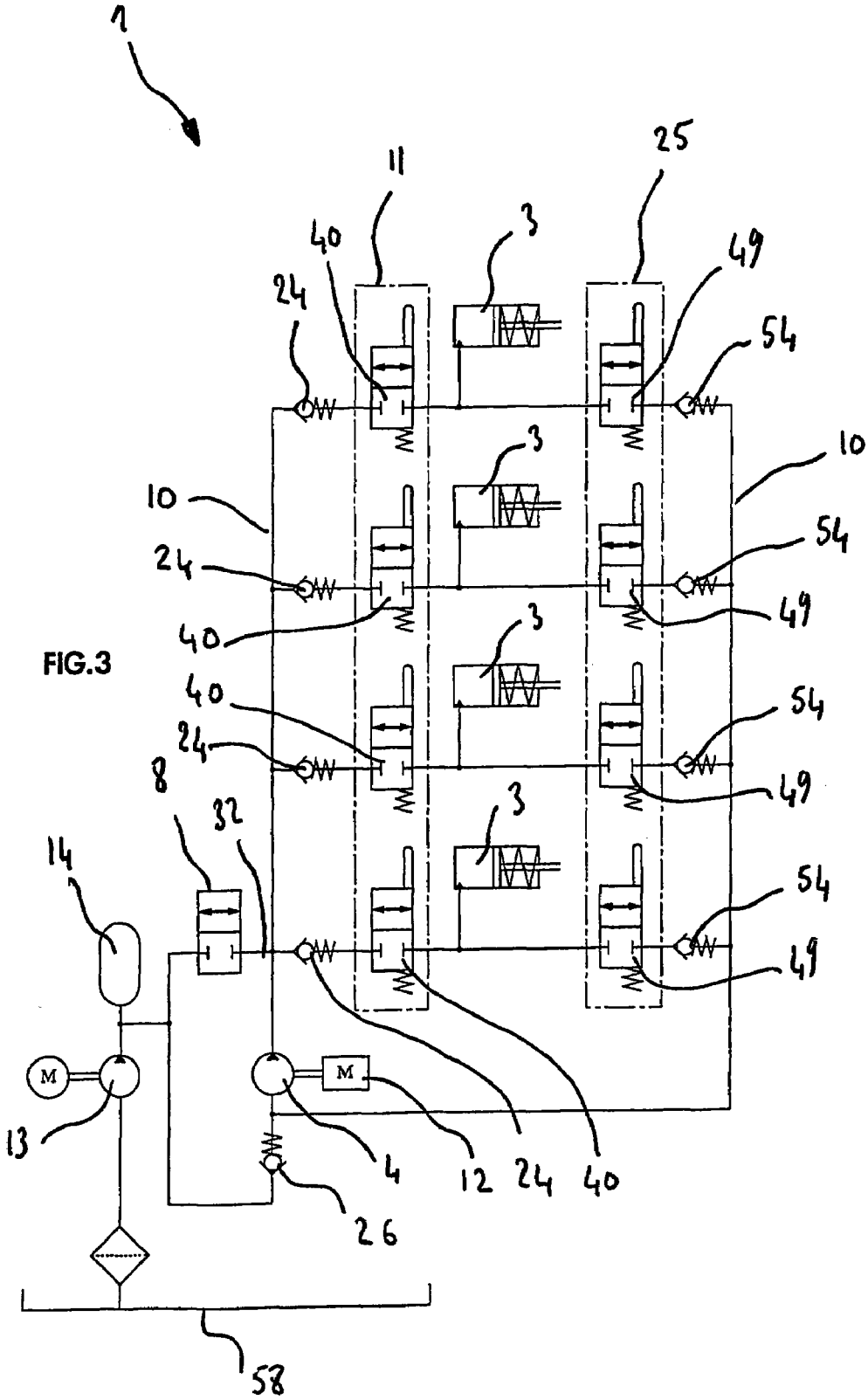
FIG. 3 is a diagrammatic illustration of a circuit, the functioning of which is identical to the preceding one, but which operates at a higher pressure due to an additional pump, this being to limit the consequences of the compressibility of the hydraulic fluid and of the inertia of the valves on the operating accuracy of the device according to the present invention.
Figure 4:
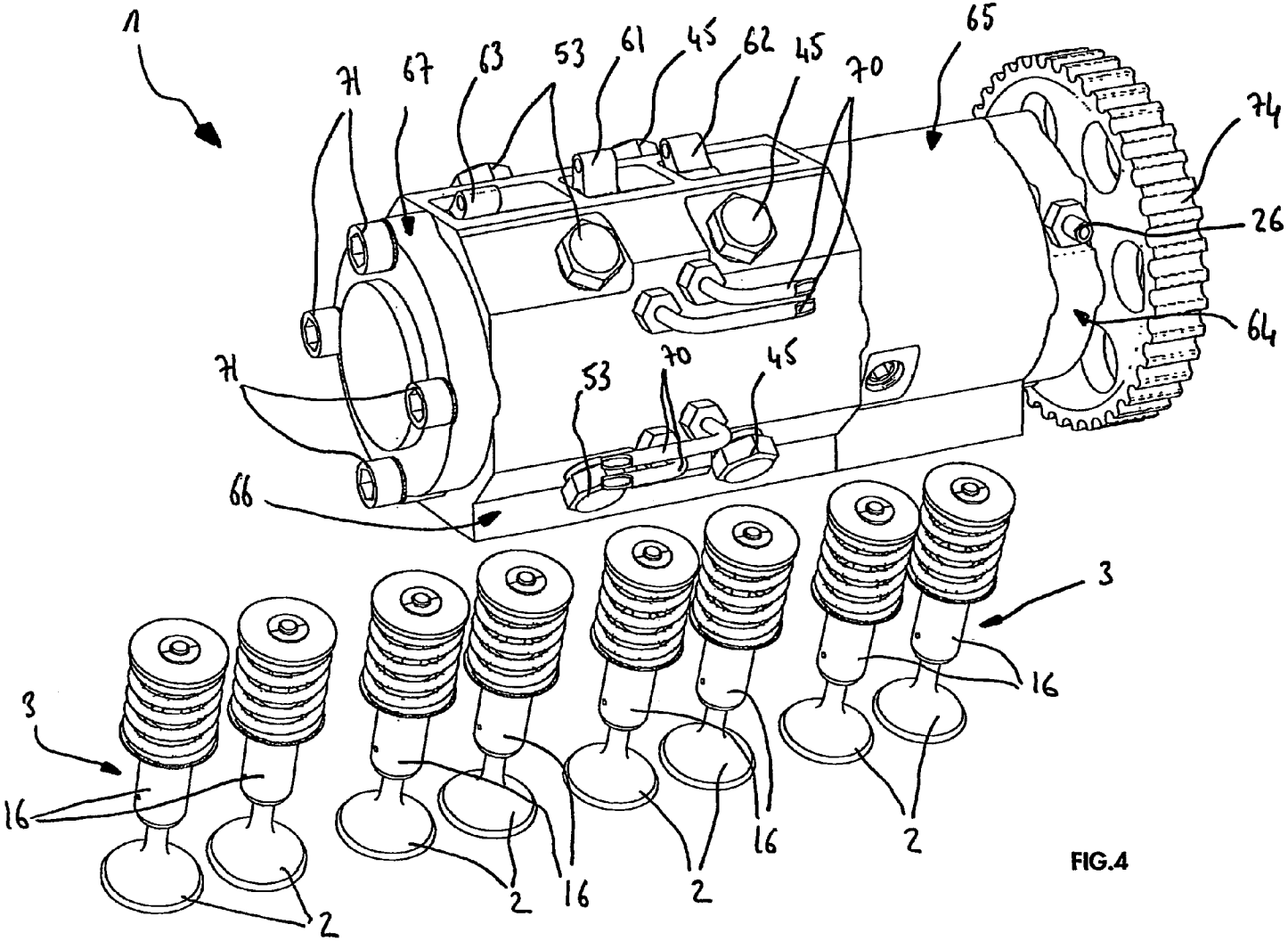
FIG. 4 is a perspective view showing the hydraulic actuator according to the present invention.

FIG. 2 is a diagrammatic illustration of a circuit, the functioning of which is identical to the preceding one, but which is intended for actuating the 8 intake or exhaust valves of a four-cylinder engine with two intake or exhaust valves per cylinder.

According to this configuration, a vane pump with a single rotor, but provided with an inner cam defining two isolated inlets and two isolated outlets, can be used, as illustrated in FIG. 8.

The pump outlet plug 8, the valve opening selector 11 and the valve closing selector 25 may be implemented by means of solenoid valves, but the fragility, lack of robustness and lack of operating uniformity of said solenoid valves in the context of a thermal engine make such implementations difficult.

For this reason, said solenoid valves are advantageously replaced by the mechanical device shown in FIGS. 15 to 21, which affords the operating reliability and constancy sought after in motor vehicle engines. The device illustrated in these figures is intended particularly for actuating the eight intake or exhaust valves of a four-cylinder engine with two intake valves or two exhaust valves per cylinder.

The variants of such a device for other engine configurations will readily become clear to a person skilled in the art.

The common shaft 59 is driven in rotation by the engine 12 by means of the pulley 74 rotating at the same speed as a conventional camshaft, that is to say at half the speed of the crankshaft 5 of the engine 12, here clockwise when the apparatus is seen from the pulley side 74.

Figure 9:
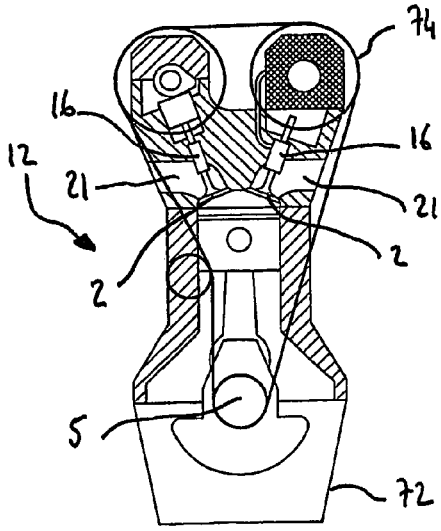
FIGS. 9 and 10 are sectional views illustrating the possible positioning of the hydraulic actuator according to the present invention on an engine.
Figure 10:
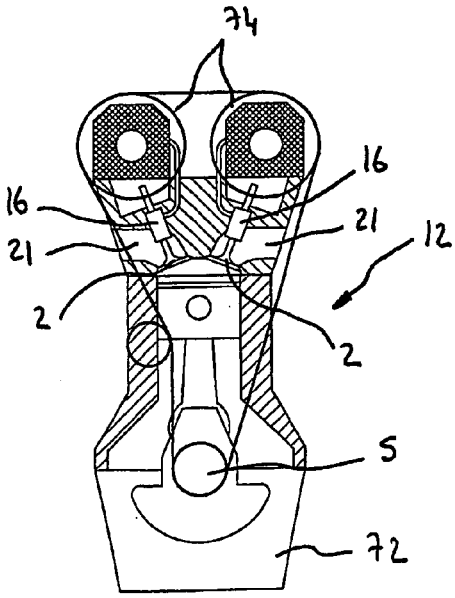

Thus, and according to a particular embodiment, the device as a whole can be put in place instead of the camshaft which it replaces (for example, the intake camshaft) and can be driven, as shown in FIG. 9, by the distribution belt of the engine with another camshaft (for example, the exhaust camshaft) or else can be driven, as shown in FIG. 10, by said belt with another identical device.

The hydraulic positive displacement pump 4 is of the vane type with an inner cam defining two pump inlets 7 and two pump outlets 6 not communicating with one another, the pump inlet nonreturn valves. 26 being connected to the low-pressure circuit 9, in this particular case the pressurized lubrication circuit of the engine 12, and consisting of balls kept in bearing contact on their seat by a spring.

When no valve is to be opened, the hydraulic positive displacement pump 4 expels the hydraulic fluid via the pump outlet duct 32 into the inner cavity of the plug housing 65, said cavity being connected by means of a duct, not illustrated, to the engine lubricating oil housing 72.

As can be seen in the figures, the common shaft 59 is equipped with helical splines 60, these splines driving in rotation the plug rotor 27, the opening selector rotor 38 and the closing selector rotor 47.

Here, the plug rotor 27 and the opening selector rotor 38 remain in phase with respect to one another, since they are integral in terms of rotation with the same sleeve 37, thus ensuring a constant duration between the selection of a valve 2 and the start of the shut-off of the pump outlet 6.

It may be noted that the functioning of the pump plugs 8, of the valve opening selector 11 and of the valve closing selector 25 is necessarily synchronized because they are all driven by the common shaft 59.

The pump outlet plugs 8 here number two placed diametrically opposite one another in the housing and each shut off one of the two pump outlets 6 of the hydraulic positive displacement pump 4, each pump outlet 8 being assigned solely to the opening either of the even valves 2 or of the odd valves 2 of the cylinders of the engine 12.

The even and odd valves 2 of the same cylinder having the same kinematics at the same moment are therefore coupled in terms of their functioning.

In the same way, the two pump inlets 7 are assigned solely to the closing either of the even valves 2 or of the odd valves 2 of the cylinders of the engine 12.

The plug rotor 27 comprises four protuberances 28 of variable profile which are placed every ninety degrees.

Since the pump outlet ports 29 are installed fixedly in the plug housing 65, a translation of the plug rotor 27 on the opening sleeve 37 changes the active length of the protuberances 28 facing the pump outlet ports 29 and thereby makes it possible to increase or reduce the number of crankshaft degrees 5 during which the opening of the valves 2 will take place.

Since the valves 2 open at a constant speed under given operating conditions of the engine 12, the longer they will be actuated in terms of opening, the greater their lift height will be.

Consequently, the valve lift fork 62 makes it possible to control the lift height of the valves 2, said fork being actuated by means of an electric motor, not illustrated, controlled by a computer, not illustrated.

The starting point for the opening of the valves 2 can be controlled independently of the lift of the valves 2 by the opening sleeve 37 being displaced in longitudinal translation with respect to the common shaft 59 by means of the valve opening advance fork 61.

This action makes it possible to shift the phase of the plug rotor 27 angularly with respect to the crankshaft 5 of the engine 12, the inner helical splines 75 of the opening sleeve 37 cooperating with the outer helical splines 60 of the common shaft 59, the result of this being that the protuberances 28 of the plug rotor 27 sooner or later shut off the pump outlet ports 29, without changing their active length which remains under the control of the valve lift fork 62.

The valve opening advance fork 61 is actuated by an electric motor, not illustrated, controlled by a computer, not illustrated.

The valve opening selector 11 and the valve closing selector 25 are both based on the same operating principle.

It will be noted that the cam 39 of the opening selector actuates a valve opening distributor 40 in terms of opening every ninety degrees of rotation of the common shaft 59, that is to say every one hundred and eighty degrees of rotation of the crankshaft 5, according to the requirements of a four-cylinder engine operating according to the four-stroke Otto or Beau de Rochas cycle.

Each valve opening distributor 40 makes it possible to open or close simultaneously the ducts 42 delivering the hydraulic fluid to the hydraulic jacks 3 of an even valve 2 and of an odd valve 2 of the same cylinder.

This result is obtained by means of the grooves 41 which are arranged on the cylindrical piece 78 of the valve opening distributor 40 and which either are opposite said ducts 42, when the cam 39 actuates the valve opening distributor 40, or shut off said ducts 42, when the cam 39 does not actuate them.

The cylindrical piece 78 is returned to the desired distance with respect to the cam 39 by means of a shoulder 44 of said cylindrical piece, kept in contact with the selector housing 66 by means of the spring 43.

The starting point for the closing of the valves 2 is controlled by the closing selector rotor 47 being displaced in longitudinal translation with respect to the common shaft 59 by means of the valve closing retard fork 63.

This action makes it possible to shift the phase of the closing selector rotor 47 angularly with respect to the crankshaft 5 of the engine 12, the inner helical splines 79 of said closing selector rotor 47 cooperating with the outer helical splines 60 of the common shaft 59, the result of this being that the valve closing distributors 49 are actuated sooner or later in order to close the valves 2 sooner or later.

It is noted that the common housing may comprise a plinth in which at least one hydraulic jack 3 is accommodated, said plinth being fastened to the cylinder head of the engine 12, so that each hydraulic jack 3 is in contact with the upper end of the stem of the corresponding valve 2 of said engine 12 and can actuate said valve.

It must be understood, moreover, that the foregoing description was given only by way of example and that it in no way limits the scope of the invention from which there would be no departure if the implementing details described were replaced by any other equivalent.

The invention claimed is:

1. A hydraulic valve actuator for reciprocating engines, comprising:

at least one hydraulic jack (3) connected to a high-pressure hydraulic circuit (10) by means of a duct and ensuring the opening of at least one valve (2), at least one hydraulic positive displacement pump (4) comprising at least one outlet and at least one inlet, and rotating at a speed proportional to that of the engine crankshaft, at least one pump outlet plug (8) which makes it possible to prevent the hydraulic fluid expelled at the outlet of the hydraulic positive displacement pump (4) from issuing into a low-pressure circuit (9) or into a reservoir (58) and to force it into a high-pressure circuit (10) communicating with one or more hydraulic jacks (3) ensuring the opening of one or more valves (2), at least one valve opening selector (11) which makes it possible to direct, via the high-pressure circuit (10), the hydraulic fluid expelled at the outlet of the hydraulic positive displacement pump (4) toward the hydraulic jack (3) of at least one valve (2) to be opened, while at the same time preventing said hydraulic fluid from being directed toward one or more other valves (2) to remain closed, at least one opening nonreturn valve (24) which is located on the high-pressure circuit (10) between the outlet or outlets of the hydraulic positive displacement pump (4) and the hydraulic jack (3) of at least one valve (2) and which makes it possible to retain the hydraulic fluid in said hydraulic jack (3) of said valve (2) in order to keep it open, at least one valve closing selector (25) which makes it possible to direct the hydraulic fluid contained in the hydraulic jack (3) of at least one valve (2) kept open by the opening nonreturn valve (24) toward the inlet or inlets of the hydraulic positive displacement pump (4), in order to ensure the closing of said valve or valves (2) and to prevent the hydraulic fluid contained in their hydraulic jacks (3) from being introduced into the hydraulic jack (3) of another valve or other valves (2) which is or are to remain in a closed position, and at least one pump inlet nonreturn valve (26) which is located at the inlet or inlets of the hydraulic positive displacement pump (4) and which makes it possible for the hydraulic fluid of the low-pressure circuit (9) or of the reservoir (58) to be admitted at the inlet or inlets of the hydraulic positive displacement pump (4) when the pressure of said low-pressure circuit (9) or of said reservoir (58) is higher than that of said inlet or inlets of the hydraulic positive displacement pump (4).

2. The hydraulic valve actuator for reciprocating engines as claimed in claim 1, wherein the cylinder and the chamber (20) of the hydraulic jack (3) ensuring the opening of the valve or valves (2) are arranged in a valve guide (16), said cylinder and said chamber (20) cooperating with a jack piston consisting of a shoulder (19) arranged on the valve stem (18) in order to open the valve (2).

3. The hydraulic valve actuator for reciprocating engines as claimed in claim 2, wherein the jack piston consisting of a shoulder (19) arranged on the valve stem (18) participates in guiding the valve (2) in the valve guide (16).

4. The hydraulic valve actuator for reciprocating engines as claimed in claim 2, wherein the jack piston consisting of a shoulder (19) on the valve stem (18) comprises at least one seal (17).

5. The hydraulic valve actuator for reciprocating engines as claimed in claim 2, wherein the valve guide (16) comprises at least one drain (22) in the vicinity of the intake or exhaust duct (21), which the cylinder head of the engine (12) comprises in order to limit the passage of the hydraulic fluid toward said intake or exhaust duct (21).

6. The hydraulic valve actuator for reciprocating engines as claimed in claim 1, wherein the hydraulic jack (3) ensuring the opening of the valve or valves (2) comprises a limit-stop damping device making it possible to brake the valve or valves (2) before said valves come into contact with their seats.

7. The hydraulic valve actuator for reciprocating engines as claimed in claim 6, wherein the hydraulic jack (3) arranged in the valve guide (16) comprises a limit-stop damping device consisting of a small shoulder (23) which is arranged on the valve stem (18) and which cooperates with cylinder portion of small height and of a diameter substantially larger than said small shoulder (23), said cylinder portion being arranged in the upper part of the valve guide (16) in order to shear the hydraulic fluid when the valve (2) reaches the end of the closing stroke, the effect of which is to reduce the speed of said valve (2).

8. The hydraulic valve actuator for reciprocating engines as claimed in claim 1, wherein the hydraulic jack (3) ensuring the opening of at least one valve (2) comprises, in the region of its chamber (20), a bleeding device consisting of a plug which can be opened by means of a command in order to make it possible for the hydraulic fluid contained in said chamber (20) to escape toward a low-pressure circuit.

9. The hydraulic valve actuator for reciprocating engines as claimed in claim 1, wherein at least one valve (2) is equipped with a measuring device emitting an electrical or electromagnetic signal which informs a computer of the lift height of the valve at a given moment.

10. The hydraulic valve actuator for reciprocating engines as claimed in claim 1, wherein the low-pressure circuit (9) is connected to the pressurized lubrication circuit (15) of the engine (12).

11. The hydraulic valve actuator for reciprocating engines as claimed in claim 1, wherein the low-pressure circuit (9) is independent of the pressurized lubrication circuit (15) of the engine (12).

12. The hydraulic valve actuator for reciprocating engines as claimed in claim 1, wherein the low-pressure circuit (9) is independent of the pressurized lubrication circuit (15) of the engine (12) and is kept at a pressure higher than the atmospheric pressure by means of an additional pump (13).

13. The hydraulic valve actuator for reciprocating engines as claimed in claim 12, wherein the low-pressure circuit (9) comprises a pressure accumulator (14).

14. The hydraulic valve actuator for reciprocating engines as claimed in claim 1, wherein the hydraulic positive displacement pump (4) is a vane pump, the stator of which has an inner profile which defines at least one inlet and one outlet which are independent.

15. The hydraulic valve actuator for reciprocating engines as claimed in claim 1, wherein the hydraulic positive displacement pump (4) is a gear pump comprising at least two pinions and at least one inlet and one outlet which are independent.

16. The hydraulic valve actuator for reciprocating engines as claimed in claim 1, wherein the hydraulic positive displacement pump (4) is a variable displacement pump which makes it possible to vary the lifting speed of the valve or valves (2) of the engine (12) under given operating conditions of said engine.

17. The hydraulic valve actuator for reciprocating engines as claimed in claim 1, wherein the pump outlet plug (8) is a solenoid valve controlled by a computer.

18. The hydraulic valve actuator for reciprocating engines as claimed in claim 1, wherein the pump outlet plug (8) is a rotary mechanical device contained in a plug housing (65) and rotating at a speed proportional to that of the crankshaft (5) of the engine (12), and comprising a plug rotor (27) equipped with at least one protuberance (28) periodically plugging one or more pump outlet ports (29) accommodated in said plug housing (65) during the rotation of said plug rotor (27).

19. The hydraulic valve actuator for reciprocating engines as claimed in claim 18, wherein the leaktightness between the pump outlet port or ports (29) and the protuberances (28) of the plug rotor (27) is reinforced by a device (30) for keeping said pump outlet port or ports (29) in contact with said protuberances (28) when the latter are positioned opposite said pump outlet port or ports (29).

20. The hydraulic valve actuator for reciprocating engines as claimed in claim 18, wherein the device (30) for keeping in contact consists of a plug piston (31) which is positioned radially in the plug housing (65) and which comprises a pump outlet port (29) which passes right through it longitudinally, said pump outlet port (29) being connected to a pump outlet duct (32) by means of a radial port (33), said plug piston (31) comprises a concave cylindrical bearing face having a radius substantially identical to that of the protuberances (28), so as to have a wide contact surface with said protuberances (28), the plug piston (31) has, on the side of the plug housing (65), a surface subjected to the pressure of the hydraulic fluid which is greater than the contact surface which it has with the protuberances (28), so that said plug piston is kept in contact with said protuberances when the pressure of the fluid increases in the pump outlet duct (32) during the passage of said protuberances (28), and, when there is no protuberance plugging the pump outlet port (29) of the plug piston (31), the latter is kept in bearing contact on the plug housing (65) by means of a spring (56).

21. The hydraulic valve actuator for reciprocating engines as claimed in claim 20, wherein the plug piston (31) comprises at least one seal ensuring leaktightness between said plug piston (31) and the bore in which it is accommodated.

22. The hydraulic valve actuator for reciprocating engines as claimed in claim 18, wherein the plug rotor (27) is equipped with a device for angular phase shift with respect to the crankshaft (5) of the engine (12), so the opening of the valve or valves (2) can be advanced or retarded.

23. The hydraulic valve actuator for reciprocating engines as claimed in claim 22, wherein that the angular phase-shifting device of the plug rotor (27) consists of at least one helical spline arranged on the inside of said plug rotor (27) and cooperating with at least one helical spline arranged on the outside of the driveshaft of said plug rotor (27), the phase shift taking place by means of the translation of said plug rotor (27) parallel to its axis of rotation by means of a fork, and the protuberances being of sufficient width to plug the pump outlet port or ports (29) accommodated in said plug housing (65), whatever their position with respect to the latter.

24. The hydraulic valve actuator for reciprocating engines as claimed in claim 22, wherein the angular phase-shifting device of the plug rotor (27), which makes it possible to advance or retard the opening of the valve or valves (2), consists of an opening sleeve (37) comprising, on the one hand, at least one inner helical spline (75) cooperating with at least one outer helical spline (60) which the driveshaft of said opening sleeve (37) comprises and, on the other hand, at least one straight outer spline (76) cooperating with at least one straight inner spline (34) which the plug rotor (27) comprises, said opening sleeve (37) being capable of being actuated in terms of translation parallel to its axis of rotation by means of a valve opening advance fork (61), in order to advance or retard the opening of the valve or valves (2) by means of the angular phase shift of the plug rotor (27) which it drives in rotation, while the lift of the valve or valves (2) is controlled independently by means of the valve lift fork (62) which acts on the longitudinal position of the plug rotor (27) with respect to the pump outlet port or ports (29), said plug rotor (27) comprising the protuberances (28) of variable cross section which ensure a variable plugging time.

25. The hydraulic valve actuator for reciprocating engines as claimed in claim 18, wherein that the protuberances (28) of the plug rotor (27) are wide and of variable cross section over the length of the plug rotor (27), so that they have a plugging time which varies as a function of the longitudinal position of the plug rotor (27) with respect to the pump outlet port or ports (29), thus making it possible to increase or reduce the lift stroke of the valve or valves (2), and the longitudinal position of the plug rotor (27) with respect to said pump outlet port or ports (29) is controlled by means of a valve lift fork (62) which makes it possible to impart to said plug rotor (27) a translation parallel to its axis of rotation, said plug rotor (27) comprising at least one straight inner spline cooperating with at least one straight outer spline which a driveshaft comprises.

26. The hydraulic valve actuator for reciprocating engines as claimed in claim 18, wherein the pump outlet port or ports (29) which the protuberances (28) of the plug rotor (27) shut off issue on the inside of a common housing which comprises a common shaft (59), said common housing forming a closed chamber connected:

to an engine lubricating oil housing (72) by means of a duct, or to a pressurized lubrication circuit (15) of the engine (12), or to a hydraulic fluid housing independent of the engine lubricating oil housing (72), or kept under pressure by an additional pump (13).

27. The hydraulic valve actuator for reciprocating engines as claimed in claim 1, wherein the valve opening selector (11) consists of one or more solenoid valves controlled by a computer.

28. The hydraulic valve actuator for reciprocating engines as claimed in claim 1, wherein the valve opening selector (11) is a rotary mechanical device contained in a housing and rotating at a speed proportional to that of the crankshaft (5) of the engine (12).

29. The hydraulic valve actuator for reciprocating engines as claimed in claim 1, wherein the valve opening selector (11) is a rotary mechanical device contained in a selector housing (66), rotating at a speed proportional to that of the crankshaft (5) of the engine (12) and comprising an opening selector rotor (38) equipped with a cam (39) which actuates one or more valve opening distributors arranged radially in the selector housing (66).

30. The hydraulic valve actuator for reciprocating engines as claimed in claim 29, wherein the opening selector rotor (38) is equipped with a device for angular phase shift with respect to the crankshaft (5) of the engine (12), so that the valve opening selector (11) can be synchronized with the pump outlet plug (8) and can select the valve or valves (2) at the desired moment.

31. The hydraulic valve actuator for reciprocating engines as claimed in claim 30, wherein the angular phase-shifting device of the opening selector rotor (38) consists of at least one helical spline (77) arranged on the inside of said opening selector rotor (38) and cooperating with at least one helical spline arranged on the outside of the driveshaft of said opening selector rotor (38), the phase shift taking place by means of a fork as a result of the translation of said opening selector rotor (38) parallel to its axis of rotation, and the cam (39) being of sufficient width to actuate the valve opening distributors, whatever its longitudinal position with respect to the latter.

32. The hydraulic valve actuator for reciprocating engines as claimed in claim 29, wherein the opening selector rotor (38) comprising a cam (39) is integral with an opening sleeve (37), thus making it possible for the valve opening selector (11) to remain synchronized with the opening moment of the valve or valves (2) which depends on the angular phase shift of a plug rotor (27) with respect to the crankshaft (5) of the engine (12), a valve opening advance fork (61) then making it possible, simultaneously and in the same proportions, to shift the phase of the opening selector rotor (38) and the plug rotor (27) with respect to the crankshaft (5).

33. The hydraulic valve actuator for reciprocating engines as claimed in claim 29, wherein each valve opening distributor (40) consists of a cylindrical piece (78) equipped with at least one groove (41) and accommodated in a bore arranged in the selector housing (66), each groove (41) being brought, by means of the axial translation of the cylindrical piece (78) imparted by the cam (39), level with at least one duct (42) arranged in the selector housing (66), in order to make it possible for the hydraulic fluid to circulate in each duct (42), said cylindrical piece (78) being kept at a desired distance from the opening selector rotor (38) by the twin action of a shoulder (44) arranged on said cylindrical piece (78) and bearing on the selector housing (66) and of a spring (43) kept compressed by a cap (45) screwed into the selector housing (66).

34. The hydraulic valve actuator for reciprocating engines as claimed in claim 33, wherein the cap (45) screwed in the selector housing (66) defines a chamber (46) which contains the spring (43) and which is connected to the low-pressure circuit (9) or to the reservoir (58) by means of a duct.

35. The hydraulic valve actuator for reciprocating engines as claimed in claim 1, wherein the valve closing selector (25) consists of one or more solenoid valves controlled by a computer.

36. The hydraulic valve actuator for reciprocating engines as claimed in claim 1, wherein the valve closing selector (25) is a rotary mechanical device contained in a housing and rotating at a speed proportional to that of the crankshaft (5) of the engine (12).

37. The hydraulic valve actuator for reciprocating engines as claimed in claim 1, wherein the valve closing selector (25) is a rotary mechanical device contained in a housing and rotating at a speed proportional to that of the crankshaft (5) of the engine (12) and comprising a closing selector rotor (47) equipped with a cam (48) which actuates one or more valve closing distributors arranged radially in said housing.

38. The hydraulic valve actuator for reciprocating engines as claimed in claim 37, wherein the closing selector rotor (47) is equipped with a device for angular phase shift with respect to the crankshaft (5) of the engine (12), so that the closing of the valve or valves (2) can be advanced or retarded.

39. The hydraulic valve actuator for reciprocating engines as claimed in claim 37, wherein the phase-shifting device of the closing selector rotor (47) consists of at least one helical spline (79) arranged on the inside of said closing selector rotor (47) and cooperating with at least one helical spline arranged on the outside of the driveshaft of said closing selector rotor (47), the phase shift taking place by means of a valve closing retard fork (63) by means of the translation of said closing selector rotor (47) parallel to its axis of rotation, and the cam (48) being of sufficient width to actuate the valve closing distributors (49), whatever its longitudinal position with respect to the latter.

40. The hydraulic valve actuator for reciprocating engines as claimed in claim 37, wherein each valve closing distributor (49) consists of a cylindrical piece (80) equipped with at least one groove (50) and accommodated in a bore arranged in the selector housing (66), each groove (50) being brought, by means of the axial translation of the cylindrical piece (80) imparted by the cam (48), level with at least one duct (42) arranged in the selector housing (66), in order to make it possible for the hydraulic fluid to circulate in each duct (42), said cylindrical piece (80) being kept at a desired distance from the closing selector rotor (47) by the twin action of a shoulder (51) arranged on said cylindrical piece (80) and bearing on the selector housing (66) and of a spring (52) kept compressed by a cap (53) screwed into the selector housing (66).

41. The hydraulic valve actuator for reciprocating engines as claimed in claim 40, wherein the cap (53) screwed in the selector housing (66) defines a chamber (73) which contains the spring (52) and which is connected to the low-pressure circuit (9) or to the reservoir (58) by means of a duct.

42. The hydraulic valve actuator for reciprocating engines as claimed in claim 1, wherein the high-pressure circuit (10) comprises at least one closing nonreturn valve (54) upstream or downstream of the valve closing selector (25), in order to prevent the hydraulic fluid contained in the hydraulic jack (3) of one or more valves (2) in the closing phase from being capable of being introduced into the hydraulic jack (3) of another valve or other valves (2) which are to remain closed.

43. The hydraulic valve actuator for reciprocating engines as claimed in claim 42, wherein the closing nonreturn valve (54) positioned upstream or downstream of the valve closing selector (25) consists of a ball kept on its seat by means of a spring.

44. The hydraulic valve actuator for reciprocating engines as claimed in claim 1, wherein the pump inlet nonreturn valve (26) consists of a ball kept on its seat by means of a spring.

45. The hydraulic valve actuator for reciprocating engines as claimed in claim 1, wherein the hydraulic positive displacement pump (4), the pump outlet plug (8), the valve opening selector (11), the opening nonreturn valve or valves (24), the valve closing selector (25) and a closing nonreturn valve or valves (54), as components, are contained together or in groups in a common housing consisting of one or more parts.

46. The hydraulic valve actuator for reciprocating engines as claimed in claim 45, wherein the common housing consists of four main housings which contain the common shaft (59) and which are assembled end to end, with respectively:

- a pump housing (64) comprising the hydraulic positive displacement pump (4) and the pump inlet nonreturn valve or valves (26),
- a plug housing (65) containing the plug rotor (27) and the pump outlet port or ports (29),
- a selector housing (66) containing a valve lift fork (62), the opening selector rotor (38), valve opening distributor or distributors (40), valve opening advance fork (61), the closing selector rotor (47), the valve closing distributor or distributors (49), a valve closing retard fork (63) and the opening nonreturn valve or valves (24) and capable of comprising the closing nonreturn valve or valves (54), and a closing collector housing (67).

47. The hydraulic valve actuator for reciprocating engines as claimed in claim 46 wherein the plug housing (65) has passing through it ducts connecting the outlet or outlets (6) of the hydraulic positive displacement pump (4) to the pump outlet plug plugs (8), on the one, and to an opening collector (68) consisting of a network of ducts which is arranged at the parting plane between the plug housing (65) and the selector housing (66), on the other hand, and connecting the inlet or inlets (7) of the hydraulic positive displacement pump (4) to a closing collector (69) consisting of a network of ducts which is arranged at the parting plane between the selector housing (66) and closing collector housing (67).

48. The hydraulic valve actuator for reciprocating engines as claimed in claim 46, wherein the selector housing (66) has passing through it longitudinally ducts (42) which connect an opening collector (68) and collector (69) and which can be shut off or opened by means of the valve opening distributor or distributors (40) and by means of the valve closing distributor or distributors (49), said ducts (42) comprising valve outgoing ducts (70) which are located between the valve opening distributor or distributors (40) and the valve closing distributor or distributors (49) and which are connected to the hydraulic jack (3) of the valve or valves (2), said selector housing (66) likewise having passing through it longitudinally one or more ducts which connect the closing connector (69) to the inlet or inlets (7) of the hydraulic positive displacement pump (4).

49. The hydraulic valve actuator for reciprocating engines as claimed in claim 48, wherein the opening collector (68) makes it possible to connect to one another the ducts (42) which pass longitudinally through the selector housing (66) and which are to be connected to a same pump outlet (6), said pump outlet (6) being connected to said opening collector (68) by means of the duct which passes through the plug housing (65), while the closing collector (69) makes it possible to connect to one another the ducts (42) which pass longitudinally through the selector housing (66) and which are to be connected to the same pump inlet (7), said pump inlet (7) being connected to said closing collector (69) by means of the ducts (42) which pass respectively through the selector housing (66) and the plug housing (65).

50. The hydraulic valve actuator for reciprocating engines as claimed in claim 46, further comprising assembly screws (71) pass right through the various housings (64, 65, 66 and 67) in order to keep them assembled, one or more of said assembly screws (71) being capable of serving as slideway for the forks (61, 62 and 63) which make it possible to control the opening, lift and closing of the valves (2).

51. The hydraulic valve actuator for reciprocating engines as claimed in claim 1, wherein the hydraulic positive displacement pump (4), a plug rotor (27), an opening selector rotor (47) or any combination of these four devices are driven in rotation by means of a common shaft (59), itself driven in rotation by the crankshaft (5) of the engine (12) by means of a transmission device.

52. The hydraulic valve actuator for reciprocating engines as claimed in claim 51, characterized in that the transmission device driving the common shaft (59) consists of a pulley (74) driven in rotation by the crankshaft (5) of the engine (12) by means of a notched belt or a chain or a gear system consisting of at least one pinion.

53. The hydraulic valve actuator for reciprocating engines as claimed in claim 51 wherein the common shaft (59) is equipped with at least one helical spline (60) which drives in rotation the plug rotor (27), the opening selector rotor (38), the opening sleeve (37) and the closing selector rotor (47) or any combination of these three devices and cooperates with the helical splines of some of its devices in order to allow their angular phase shift with respect to the crankshaft (5) of the engine (12).

54. The hydraulic valve actuator for reciprocating engines as claimed in claim 1 wherein a valve opening advance fork (61), a valve lift fork (62) and a valve closing retard fork (63) are actuated in terms of translation by means of electric motors controlled by a computer and connected to said forks (61, 62 and 63) by transmission-means.

55. The hydraulic valve actuator for reciprocating engines as claimed in claim 1, wherein the duct connected to the high-pressure hydraulic circuit (10) simultaneously feeds a plurality of hydraulic jacks (3) via a flow divider which ensures the valves (2) actuated by said hydraulic jacks (3) have a substantially identical lift.

56. The hydraulic valve actuator for reciprocating engines as claimed in claim 1, wherein the pump outlet plug (8) and the valve opening selector (11) are gathered together in a single combined distributor (81) comprising at least one inlet connected to an outlet (6) of the hydraulic positive displacement pump (4) and capable of being put in relation either with an outlet connected to the low-pressure circuit (9) or with an outlet connected to at least one hydraulic jack (3).

57. The hydraulic valve actuator for reciprocating engines as claimed in claim 1 wherein a common housing comprises a plinth in which at least one hydraulic jack (3) is accommodated, said plinth being fastened to the cylinder head of the engine (12), so that each hydraulic jack (3) is in contact with the upper end of the stem of the corresponding valve (2) of said engine (12) and can actuate said valve.

* * * * *